US010427280B2

(12) United States Patent
Zelniker

(10) Patent No.: US 10,427,280 B2
(45) Date of Patent: Oct. 1, 2019

(54) ADJUSTABLE GRIPPING TOOL

(71) Applicant: Cory M. Zelniker, Great Neck, NY (US)

(72) Inventor: Cory M. Zelniker, Great Neck, NY (US)

( * ) Notice: Subject to any disclaimer, the term of this patent is extended or adjusted under 35 U.S.C. 154(b) by 246 days.

(21) Appl. No.: 15/674,170

(22) Filed: Aug. 10, 2017

(65) Prior Publication Data

US 2018/0043515 A1 Feb. 15, 2018

Related U.S. Application Data

(60) Provisional application No. 62/373,629, filed on Aug. 11, 2016.

(51) Int. Cl.
*B25B 23/10* (2006.01)
*B25B 13/46* (2006.01)
*B25B 13/18* (2006.01)

(52) U.S. Cl.
CPC ..... *B25B 23/108* (2013.01); *B25B 13/18* (2013.01); *B25B 13/463* (2013.01); *B25B 13/467* (2013.01)

(58) Field of Classification Search
CPC ..... B25B 23/108; B25B 13/18; B25B 13/463; B25B 13/467
See application file for complete search history.

(56) References Cited

U.S. PATENT DOCUMENTS 3,724,299 A 4/1973 Nelson
4,676,125 A 6/1987 Ardelean
5,076,121 A 12/1991 Fosella
5,090,273 A 2/1992 Fossella
5,448,931 A 9/1995 Fossella
6,341,544 B1 1/2002 Falzone
6,889,579 B1 5/2005 Brown
6,971,284 B2 12/2005 Owoc
7,707,916 B2 5/2010 Pirseyedi
7,992,470 B2 8/2011 Brown
8,402,863 B2 3/2013 Brown
8,677,864 B1 3/2014 Wheeler
(Continued)

OTHER PUBLICATIONS

International Search Report and Written Opinion for PCT Application No. PCT/US2017/046330, dated Nov. 2, 2017; ten (10) pages.

*Primary Examiner* — David B. Thomas
(74) *Attorney, Agent, or Firm* — Gerald Hespos; Michael Porco; Adam Hotzoglou

(57) ABSTRACT

An adjustable gripping tool including an adjustable opening to grip and impart work or a rotational force on work pieces (e.g., nuts and bolts) of various sizes is provided. The gripping tool of the present disclosure includes a ratcheting configuration and an adjusting configuration and can change between each configuration. While in the adjusting configuration, an adjusting bolt may be rotated to cause a plurality of jaws or gripping members to converge toward each other or diverge away from each other to adjust the diameter of the opening of the gripping tool. In this way, the plurality of jaws may converge onto work pieces of various sizes to grip the work pieces securely in the opening. The gripping tool may then be changed to the ratcheting configuration. In the ratcheting configuration, a handle of the gripping tool may be gripped and rotated to impart work on the work piece.

20 Claims, 34 Drawing Sheets

(56) References Cited

U.S. PATENT DOCUMENTS

| | | | | |
|---|---|---|---|---|
| 9,889,544 | B2 * | 2/2018 | Chern | B25B 13/18 |
| 2005/0166717 | A1 | 8/2005 | Owoc | |
| 2013/0263705 | A1 | 10/2013 | Broadaway et al. | |
| 2014/0053693 | A1 | 2/2014 | Womack | |
| 2014/0331823 | A1 | 11/2014 | Chiriac | |
| 2018/0015593 | A1 * | 1/2018 | Wang | B25B 13/14 |

* cited by examiner

ADJUSTABLE GRIPPING TOOL

PRIORITY

This application claims priority to U.S. Provisional Patent Application No. 62/373,629, filed on Aug. 11, 2016, entitled "UNIVERSAL RATCHETING SOCKET WRENCH", the contents of which are hereby incorporated by reference in its entirety.

TECHNICAL FIELD

The present disclosure generally relates to gripping tools, and more particularly, to an adjustable gripping tool for gripping work pieces of various sizes.

BACKGROUND

Wrenches are available in a wide variety of styles and sizes. The most common types of wrenches are likely the open-end wrench and the box wrench. The open-end wrench has an opening of particular size and two parallel sides for engaging opposite sides of a work piece (e.g., a nut or bolt). The box wrench generally has a polygonal opening for contacting the circumferential surfaces of a work piece.

There also exist ratcheting socket wrenches, which hasten the process of inserting or removing a work piece considerably since ratcheting socket wrenches do not require that the wrench be removed from the work piece at the end of each turn. Ratcheting socket wrenches also have the advantage of being employable for a variety of work pieces, as sockets of diverse size may be releasably attached to the ratcheting body.

Most conventional ratcheting socket wrenches in use today require a large number of interchangeable socket heads so as to accommodate work pieces of different diameters. For example, approximately 41 different socket heads are required to accommodate both standard and metric sizes within the range of from 5/16 to 1 inch in diameter. An additional equal number of socket heads may be required if deep bolt clearance is necessary for the work to be performed. A complete set of sockets is expensive, bulky and heavy to carry about, and are very easily lost. Accordingly, there remains a need for alternative wrenches and/or gripping tools, to accommodate a wide range of sizes of work pieces, such as nuts, bolts, and other work pieces.

SUMMARY

In one aspect of the present disclosure, an adjustable gripping tool configured with an adjustable opening to grip and impart work or a rotational force (e.g., torque) on work pieces (e.g., nuts and bolts) of various sizes is provided. The adjustable gripping tool of the present disclosure includes a ratcheting configuration and an adjusting configuration and a means by which to change between each configuration. While the adjustable gripping tool is in the adjusting configuration, an adjusting bolt may be rotated to cause a plurality of jaws or gripping members to converge toward each other or diverge away from each other to adjust the diameter of the opening of the gripping tool. In this way, the plurality of jaws may converge onto work pieces of various sizes to grip the work pieces securely in the opening. After a work piece has been securely gripped by the plurality of jaws by adjusting the opening, the gripping tool may be switched to the ratcheting configuration. In the ratcheting configuration, a handle of the gripping tool may be gripped and rotated to impart work or a rotational force on the work piece.

In one aspect of the present disclosure, an adjustable gripping tool is provided including: a generally cylindrical frame aligned along an axis, the frame including at least a first and second radial slot; at least a first and second jaw, each jaw slidably disposed in a respective radial slot such that the motion of each jaw is limited to linear radial motion toward or away from the axis, a first disc rotatable about the axis and coupled to each of the jaws such that the rotation of the first disc with respect to the frame advances or retracts each jaw within each radial slot toward or away from the axis, and wherein the first disc is slidable along the axis with respect to the frame in a direction toward or away from the frame; a second disc rotatable about the axis; a ratcheting assembly including a main body and a sliding member, the main body including a first end and a second end aligned along the axis, the main body rotatable about the axis, the second end including a gear, the sliding member coupled to the first disc and configured to slide along the axis independently from the main body in a direction toward or away from the frame to slide the first disc toward or away from the frame; and a switching assembly coupled to the gear of the main body and configured to engage the gear to selectively rotate the gear in a first direction or a second direction about the axis, wherein when the sliding member is advanced along the axis in a direction toward the frame, the first disc is advanced along the axis and the first end of the main body of the ratcheting assembly is coupled to the first disc such that the rotation of the gear of the main body controls the rotation of the first disc, and wherein when the sliding member is retracted along the axis in a direction away from the frame, the first disc is retracted along the axis and is uncoupled from the first end of the main body of the ratcheting assembly and the first disc is coupled to the second disc such that the rotation of the second disc controls the rotation of the first disc.

In another aspect of the present disclosure the adjusting gripping tool includes, wherein each jaw includes a first surface oriented toward the axis, the surfaces of the at least first and second jaws defining an adjustable opening configured to receive a work piece, and wherein when the first disc is coupled to the second disc, the second disc may be rotated about the axis such that the work piece is gripped by the first surfaces of each respective jaw.

In another aspect of the present disclosure the adjusting gripping tool includes, wherein after the work piece is gripped by each of the jaws, the sliding member may be advanced along the axis toward the frame to couple the first disc to the first end of the main body and the gear of the main body may be rotated to rotate first disc and the frame in unison to impart work onto the work piece.

In another aspect of the present disclosure the adjusting gripping tool includes, wherein the second disc includes an aperture, and the main body and sliding member are disposed through the aperture of the second disc.

In another aspect of the present disclosure the adjusting gripping tool includes, wherein the first disc includes an aperture defined by an inner circumference of the first disc, wherein the inner circumference of the first disc includes a plurality of gear teeth disposed about the inner circumference and the first end of the main body includes a gear configured to mate with the plurality of gear teeth of the first disc when the first end of the main body is coupled to the first disc.

In another aspect of the present disclosure the adjusting gripping tool includes, wherein the first disc includes a gear slot and the second disc includes a surface and a gear tab protruding from the surface, wherein when the first disc is coupled to the second disc, the gear tab is disposed in the gear slot.

In another aspect of the present disclosure the adjusting gripping tool includes, wherein the main body includes a channel extending from the first end to the second end of the main body and an aperture in a side of the main body, the aperture providing access to a portion of the channel, the ratcheting assembly including a pin that is at least partially disposed in the channel and slidable within the channel along the axis in a direction toward or away from the frame, wherein the sliding member is coupled to the pin, the pin controlling the sliding of the first disc along the axis.

In another aspect of the present disclosure the adjusting gripping tool includes, wherein an outer circumference of the first disc includes a plurality of gear teeth disposed about the outer circumference and the frame includes a side having a lip, the lip having an inner circumference including a plurality of gear teeth disposed about the inner circumference, wherein when the first disc is advanced along the axis toward the frame, the plurality of gear teeth of the outer circumference of the first disc mate with the plurality of gear teeth of the inner circumference of the lip, such that, when the first disc is rotated, the frame, came disc, and at least first and second jaws are rotated in unison.

In another aspect of the present disclosure the adjusting gripping tool includes, wherein the frame includes a circular slot in an inner circumference of the frame and the adjustable gripping tool further comprises a cam disc slidably disposed in the circular slot such that the cam disc is rotatable with respect to the frame about the axis, the first disc coupled to the cam disc such that when the first disc is rotated, the second disc is also rotated, the cam disc including at least a first and second guide slot, each guide slot including a first end and a second end, the second end of each guide slot disposed more proximately to the axis than the first end of each guide slot, and wherein an end of each of the jaws is slidably coupled to a respective guide slot such that when the cam disc is rotated with respect to the frame about the axis each of the jaws advanced or retraced toward or away from the axis.

In another aspect of the present disclosure the adjusting gripping tool includes, wherein the first disc is coupled to the cam disc via a plurality of compressible pistons, the plurality of pistons biasing the first disc in a direction away from the frame along the axis.

In another aspect of the present disclosure the adjusting gripping tool includes, further comprising a housing, the housing including a generally cylindrical head portion, the head portion including an opening revealing a hollow interior, wherein the first disc, second disc, and ratcheting assembly are disposed in the hollow interior of the head portion, the switching assembly mounted to a surface of the hollow interior of the head portion.

In another aspect of the present disclosure the adjusting gripping tool includes, wherein the housing includes a shaft having a first end and a second end and disposed perpendicularly to the axis, the first end coupled to the head portion, the shaft enabling the head portion to be rotated about the axis, such that, the switching assembly selectively rotates the gear of the main body about the axis.

In another aspect of the present disclosure the adjusting gripping tool includes, wherein the second disc includes a plurality beveled gear teeth and the adjustable gripping tool further comprises an adjusting member including a bevel gear, a rod portion, and a bolt, the rod portion including a first end and a second end, the bevel gear of the adjusting member coupled to the first end of the rod portion and the bolt coupled to the second end of the rod portion, wherein the rod portion is disposed through the hollow interior of the shaft such that the bevel gear extends into the hollow interior of the head portion and is coupled to the plurality of beveled gear teeth of the second disc and the bolt extends passed the second end of the shaft, the bolt is configured to be rotated to rotate the second disc.

In another aspect of the present disclosure the adjusting gripping tool includes, further comprising a handle disposed over the shaft, the handle coupled to the rod portion and rotatable about the shaft, such that, when the handle is rotated about the shaft, rod portion is rotated.

In another aspect of the present disclosure the adjusting gripping tool includes, further comprising ring mount mounted to the interior of the head portion of the housing, the ring mount coupled to an outer circumference of second disc to mount the second disc to the interior of the head portion, such that, the second disc is rotatable about the axis relative to the ring mount.

In another aspect of the present disclosure the adjusting gripping tool includes, further comprising a plurality of ball bearings disposed between an inner circumference of the ring mount and an outer circumference of the second disc to enable the rotation of the second disc with respect to the ring mount.

In another aspect of the present disclosure the adjusting gripping tool includes, further comprising a button disposed on an exterior surface of the head portion, the button coupled to sliding member and configured to control the advancement and retraction of the sliding member along the axis.

In another aspect of the present disclosure the adjusting gripping tool includes, further comprising a handle disposed on an exterior surface of the head portion and coupled to the switching assembly, such that, the handle may be rotated in a first direction or a second direction to choose the direction the gear of the main body may be selectively rotated via the switching assembly.

In another aspect of the present disclosure, an adjustable gripping tool is provided including: a generally cylindrical frame aligned along an axis, the frame including a circular slot disposed in an inner circumference of the frame and at least a first and second radial slot; a cam disc slidably disposed in the circular slot such that the cam disc is rotatable with respect to the frame about the axis, the cam disc including at least a first and second guide slot, each guide slot including a first end and a second end, the second end of each guide slot disposed more proximately to the axis than the first end of each guide slot; at least a first and second jaw, each jaw slidably disposed in a respective radial slot such that the motion of each jaw is limited to linear radial motion toward or away from the axis, each jaw including a first end and a second end, the first end having a first surface facing the axis, the second end of each jaw is slidably coupled to a respective guide slot, wherein the cam disc is rotated about the axis with respect to the frame to advance or retract each jaw within each radial slot toward or away from the axis; a first disc rotatable about the axis and including a first side and a second side, the first side coupled to the cam disc such that when the first disc is rotated about the axis, the cam disc is rotated about the axis, and such that the first disc is slidable along the axis with respect to the frame and cam disc in a direction toward or away from the frame; a second disc including a first side and a second side, the second disc rotatable about the axis; a ratcheting assembly including a main body and a sliding member, the main body including a first end and a second end aligned along the axis, the main body rotatable about the axis, the first end disposed more proximately to the frame than the second end, the second end including a gear, the sliding member coupled to the second side of the first disc and configured to slide along the axis independently from the main body in a direction toward or away from the frame to slide the first disc toward or away from the frame; and a switching assembly coupled to the gear of the main body and configured to engage the gear to selectively rotate the gear in a first direction or a second direction about the axis, wherein when the sliding member is advanced along the axis in a direction toward the frame, the first disc is advanced along the axis and the first end of the main body of the ratcheting assembly is coupled to the first disc such that the rotation of the gear of the main body controls the rotation of the first disc, and wherein when the sliding member is retracted along the axis in a direction away from the frame, the first disc is retracted along the axis and is uncoupled from the first end of the main body of the ratcheting assembly and the second side of the first disc is coupled to the first side of the second disc such that the rotation of the second disc controls the rotation of the first disc.

In another aspect of the present disclosure, an adjustable gripping tool is provided including: a generally cylindrical frame aligned along an axis, the frame rotatable about the axis and including a circular slot disposed in an inner circumference of the frame, at least a first and second radial slot, a first side, and a second side; a cam disc slidably disposed in the circular slot such that the cam disc is rotatable with respect to the frame about the axis, the cam disc including at least a first and second guide slot, each guide slot including a first end and a second end, the second end of each guide slot disposed more proximately to the axis than the first end of each guide slot; at least a first and second jaw, each jaw slidably disposed in a respective radial slot such that the motion of each jaw is limited to linear radial motion toward or away from the axis, each jaw including a first end and a second end, the first end having a first surface facing the axis, the second end of each jaw is slidably coupled to a respective guide slot, wherein the cam disc is rotated about the axis with respect to the frame to advance or retract each jaw within each radial slot toward or away from the axis; a first disc rotatable about the axis and including a first side and a second side, the first side coupled to the cam disc such that when the first disc is rotated about the axis, the cam disc is rotated about the axis, and such that the first disc is slidable along the axis with respect to the frame and cam disc in a direction toward or away from the frame; a second disc including a first side and a second side, the second disc rotatable about the axis; a ratcheting assembly including a main body and a sliding member, the main body including a first end and a second end aligned along the axis, the main body rotatable about the axis, the first end disposed more proximately to the frame than the second end, the second end including a gear, the sliding member coupled to the second side of the first disc and configured to slide along the axis independently from the main body in a direction toward or away from the frame to slide the first disc toward or away from the frame; and a switching assembly coupled to the gear of the main body and configured to engage the gear to selectively rotate the gear in a first direction or a second direction about the axis, wherein when the sliding member is advanced along the axis in a direction toward the frame, the first disc is advanced along the axis and the first side of the first disc is coupled to the second side of the frame and the first end of the main body of the ratcheting assembly is coupled to the first disc such that the rotation of the gear of the main body causes the frame, the cam disc, and first disc to be rotated in unison about the axis, and wherein when the sliding member is retracted along the axis in a direction away from the frame, the first disc is retracted along the axis and is uncoupled from the first end of the main body of the ratcheting assembly and the second side of the frame and the second side of the first disc is coupled to the first side of the second disc such that the rotation of the second disc controls the rotation of the first disc.

BRIEF DESCRIPTION OF THE DRAWINGS

These and other objects, features and advantages of the present disclosure will be apparent from a consideration of the following Detailed Description considered in conjunction with the drawing Figures, in which.

DETAILED DESCRIPTION

Embodiments of the present disclosure will be described herein below with reference to the accompanying drawings. In the following description, well-known functions or constructions are not described in detail to avoid obscuring the present disclosure in unnecessary detail. The word "exemplary" is used herein to mean "serving as an example, instance, or illustration." Any configuration or design described herein as "exemplary" is not necessarily to be construed as preferred or advantageous over other configurations or designs. Herein, the phrase "coupled" is defined to mean directly connected to or indirectly connected with through one or more intermediate components.

The present disclosure provides an adjustable gripping tool configured with an adjustable opening to grip and impart work or a rotational force on work pieces (e.g., nuts and bolts) of various sizes. The adjustable gripping tool of the present disclosure includes a ratcheting configuration and an adjusting configuration and a means by which to change between each configuration. While the adjustable gripping tool is in the adjusting configuration, an adjusting bolt may be rotated to cause a plurality of jaws or gripping members to converge toward each other or diverge away from each other to adjust the diameter of an opening of the gripping tool. In this way, the plurality of jaws may converge onto work pieces of various sizes to grip the work pieces securely in the opening. After a work piece has been securely gripped by the plurality of jaws by adjusting the opening, the gripping tool may be switched to the ratcheting configuration. In the ratcheting configuration, a handle of the gripping tool may be gripped and rotated to impart work or a rotational force onto the work piece.

Figure 1A:
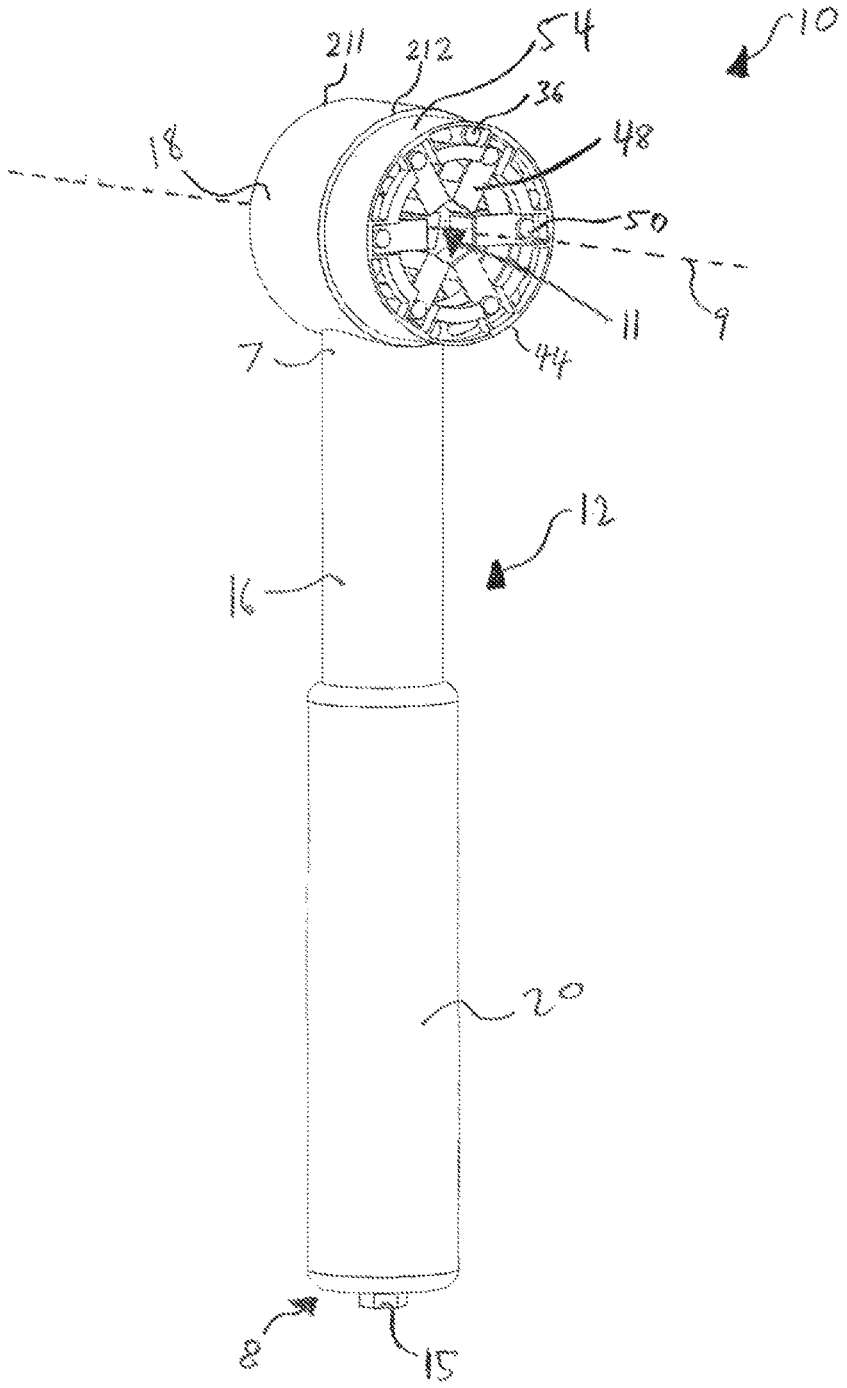
FIG. 1A is a front perspective view of an adjustable gripping tool in accordance with the present disclosure.
Figure 1B:
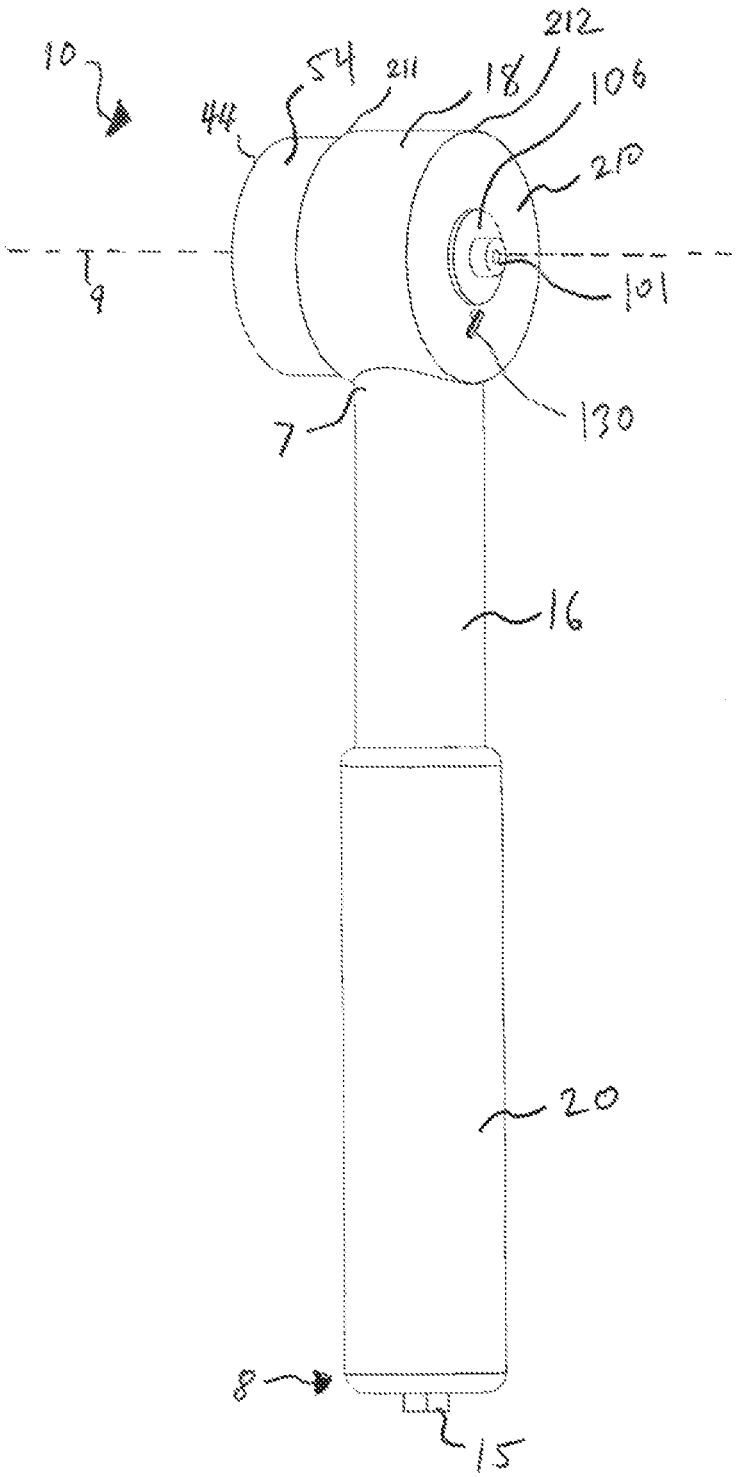
FIG. 1B is a rear perspective view of the adjustable gripping tool of FIG. 1A in accordance with the present disclosure.

Referring to FIGS. 1A and 1B, perspective views of an adjustable gripping tool 10 are shown in accordance with the present disclosure, where FIG. 1A is a perspective front view of gripping tool 10 and FIG. 1B is a perspective rear view of gripping tool 10. In one embodiment, gripping tool 10 is configured as a universal ratcheting socket wrench.

As shown in FIG. 1A, gripping tool 10 includes a housing 12 and a frame 54, where housing 12 includes a shaft 16 coupled to a wrench head or head portion 18. Wrench head 18 is configured with a generally cylindrical shape and disposed along a longitudinal axis 9, where wrench head 18 is concentric with axis 9. Shaft 16 includes ends 7 and 8. End 7 of shaft 16 is coupled to wrench head 18, such that, shaft 16 is disposed perpendicularly to the longitudinal axis 9. In one embodiment, a handle 20 may be disposed on a portion of shaft 16 beginning on end 8 of shaft 16 and extending toward end 7 of shaft 16. Handle 20 is configured to provide grip and comfort to a user using gripping tool 10.

Wrench head 18 includes sides 211, 212. Generally cylindrical frame 54 is coupled to side 212 of wrench head 18. In one embodiment, frame 54 may be at least partially disposed in an interior of wrench head 18. As will be described in greater detail below, a plurality of jaws or gripping members 48 are slidably disposed in corresponding slots of frame 54. As shown in FIG. 1B, wrench head 18 includes a button 101 disposed on a rear surface 210 of wrench head 18. The button 101 is configured to enable a user to select between an adjusting configuration and a ratcheting configuration of gripping tool 10. A lever or switch 130 is also disposed on rear surface 210. As will be described in greater detail below, the switch 130 is configured to enable a user to select a direction of rotation that work can be imparted on a work piece during the ratcheting configuration of gripping tool 10.

During the adjusting configuration, gripping tool 10 is configured such that jaws 48 can be adjusted to slide radially toward or away from longitudinal axis 9 to selectively increase or decrease the diameter an opening or area 11 defined by the plurality of jaws 48. The opening 11 is adjusted such that jaws 48 securely grip work pieces, such as hexagonal bolts, of various sizes. Once a work piece is gripped by adjusting the diameter of opening 11, a user may press button 101 to enable the ratcheting configuration of gripping tool 10. During the ratcheting configuration, frame 54 and jaws 48 are configured to rotate selectively (i.e., only in one direction) in response to shaft 16 being rotated about axis 9. In this way, during the ratcheting configuration, a user can grasp and rotate shaft 16 (via handle 20) about axis 9 to selectively rotate frame 54 and jaws 48 in a first direction (e.g., clockwise) to impart work (i.e., rotate) the work piece. During the ratcheting configuration, when a user rotates the shaft 16 in an opposite direction about axis 9 (e.g., counterclockwise), the frame 54 and jaws 48 will not be rotated with shaft 16. In this way, a user may take advantage of the ratcheting configuration of gripping tool 10 to impart work on work pieces of various sizes.

It is to be appreciated that, in one embodiment, handle 20 may be made of hydrogenated nitrile butadiene rubber, or HNBR, however, other materials may be used in accordance with the present disclosure. Furthermore, in one embodiment, housing 12, frame 54, and jaws 48 may be made of a crucible steel, such as, but not limited to, CPM® 10V crucible steel.

Figure 2A:
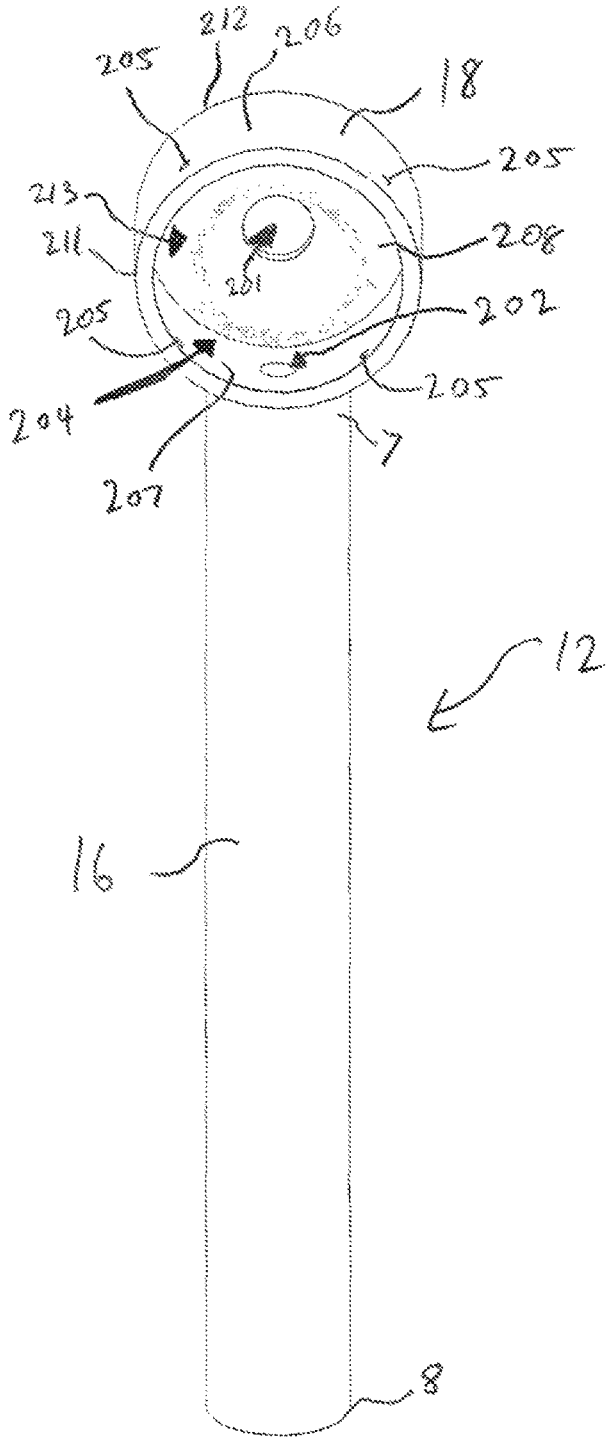
FIG. 2A is a front perspective view of a housing of the adjustable gripping tool of FIG. 1A in accordance with the present disclosure.
Figure 2B:
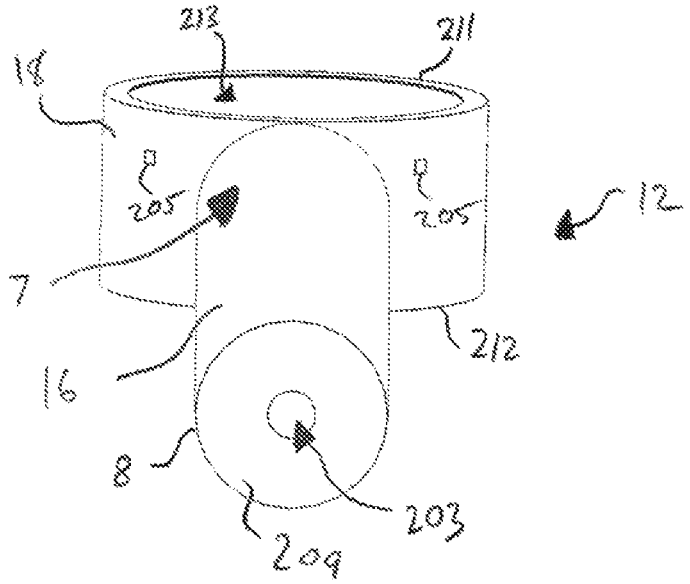
FIG. 2B is a bottom perspective view of the housing of FIG. 2A in accordance with the present disclosure.

Referring to FIGS. 2A and 2B, housing 12 is shown in accordance with the present disclosure, where FIG. 2A is a front perspective view of housing 12 and FIG. 2B is a bottom perspective view of housing 12. As shown in FIG. 2A, in one embodiment, wrench head 18 and shaft 16 are each configured in a generally cylindrical shape. Side 211 of wrench head 18 includes an opening 213 revealing hollow interior 204. The wrench head 18 includes a plurality of apertures 205 extending from an outer surface 206 of wrench head 18 to an inner surface 207 of wrench head 18. Inner surface 207 includes aperture 202, which provides access to the hollow interior of shaft 16. Interior 204 also includes a surface 208, where surface 208 includes an aperture 201. As shown in FIG. 2B, end 8 of shaft 16 includes a flat surface 209, where flat surface 209 includes aperture 203, which provides access to the hollow interior of shaft 16.

Figure 3:
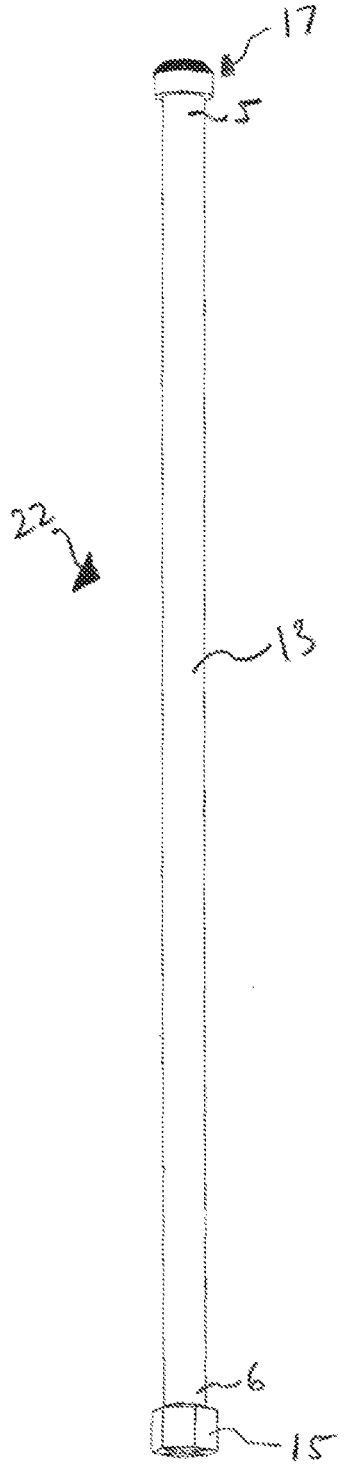
FIG. 3 is a front perspective view of an adjusting member of the adjusting gripping tool in accordance with the present disclosure.

Referring to FIG. 3, an adjusting member 22 is shown in accordance with the present disclosure. Adjusting member 22 includes a rod 13 having ends 5 and 6. End 6 of rod 13 includes adjusting bolt 15 and end 5 of rod 13 includes a bevel gear 17. Adjusting member 22 is disposed in shaft 16 of housing 12 perpendicularly to longitudinal axis 9, such that, adjusting bolt 15 is disposed exterior to surface 209 of shaft 16 and rod 13 is disposed through aperture 203 and aperture 202 (i.e., rod 13 is disposed in the hollow interior of shaft 16) and bevel gear 17 extends into the hollow interior 204 of wrench head 18. It is to be appreciated that, in one embodiment, adjusting member 22 may be made of a steel material, such as, but not limited to, American Iron and Steel Institute (AISI) 4104 steel.

Figure 4:
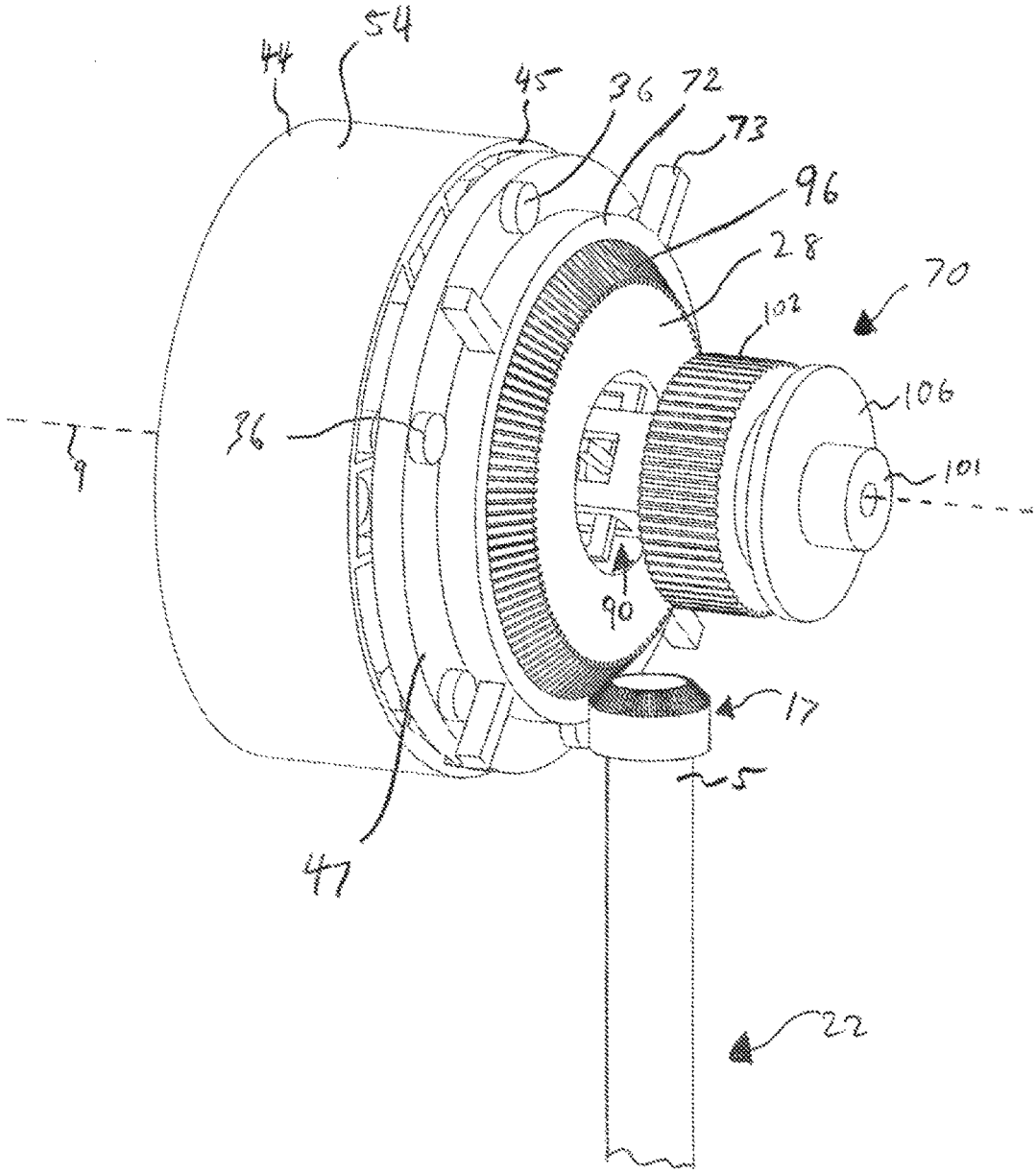
FIG. 4 is a side perspective view of an adjusting assembly and a ratcheting assembly of the adjustable gripping tool of FIG. 1A in accordance with the present disclosure.

Referring to FIG. 4, a perspective view of a portion of adjusting member 22 coupled to the internal components of wrench head 18 is shown in accordance with the present disclosure. Specifically, gear teeth of bevel gear 17 are mated with the beveled gear teeth 96 of a disc 28. As will be described in greater detail below, bolt 15 of adjusting member 22 can be rotated to rotate bevel gear 17, causing disc 28 to be rotated, and ultimately causing jaws 48 of gripping tool 10 to move toward or away from each other and axis 9 to adjust the diameter of opening 11. It is to be appreciated that adjusting bolt 15 may be shaped as a hexagonal bolt to be gripped and rotated by a tool, such as a wrench or a channel lock. Furthermore, it is to be appreciated that adjusting bolt 15 may include a Phillip's or flat head shaped aperture configured to receive a Phillip's or flat head screw driver to provide another means by which to rotate adjusting bolt 15.

Figure 5A:
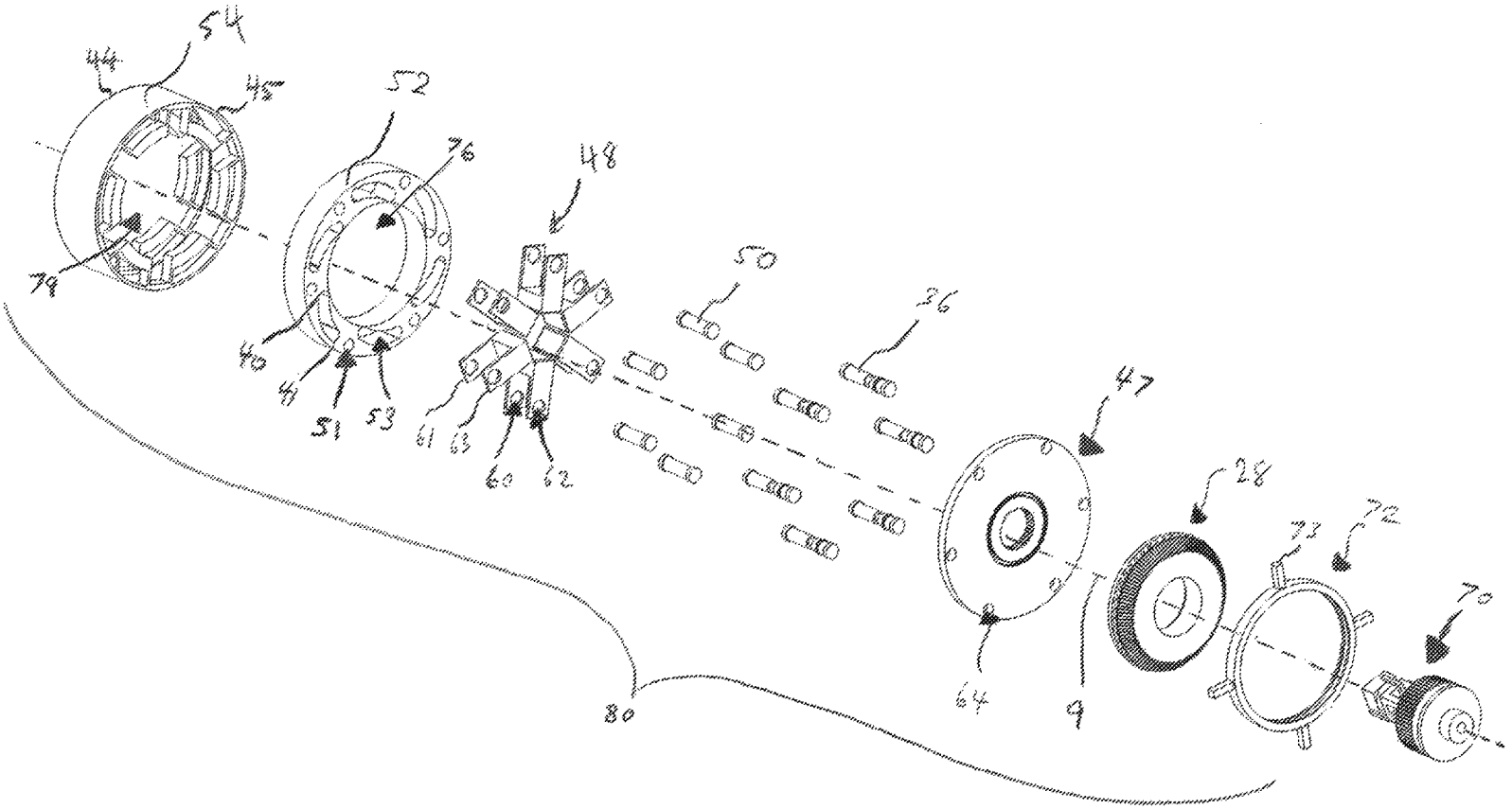
FIG. 5A is an exploded perspective view of the adjusting assembly and a perspective view of the ratcheting assembly of FIG. 4 in accordance with the present disclosure.
Figure 5B:
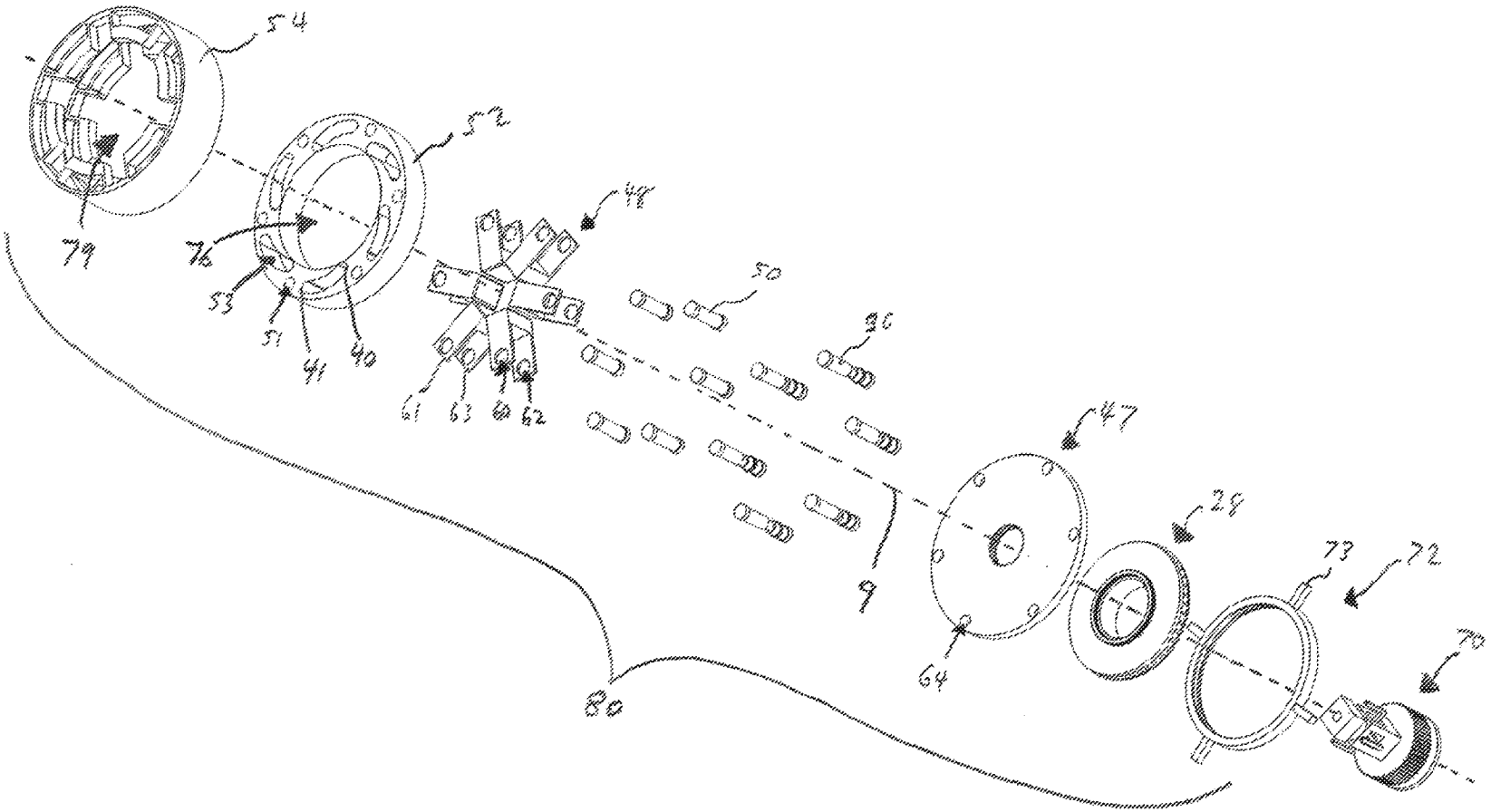
FIG. 5B is another exploded perspective view of the adjusting assembly and perspective view of the ratcheting of FIG. 4 in accordance with the present disclosure.

Referring to FIGS. 5A and 5B, exploded perspective views of several components of gripping tool 10 are shown in accordance with the present disclosure. The components in FIGS. 5A and 5B include ratcheting assembly 70, ring 72, disc 28, disc 47, pistons 36, rivets 50, jaws 48, cam disc 52, and frame 54. Components 28, 36, 47, 50, 52, 54, and 72 are included in an adjusting assembly 80 of gripping tool 10. It is to be appreciated that, although not shown in FIGS. 5A and 5B, adjusting member 22 is also included in adjusting assembly 80. It is to be appreciated that each of components 28, 47, 52, and 72 are disposed in wrench head 18. Furthermore, it is to be appreciated that each of components 28, 47, 52, 54 and 72 are concentric with axis 9.

Figure 6A:
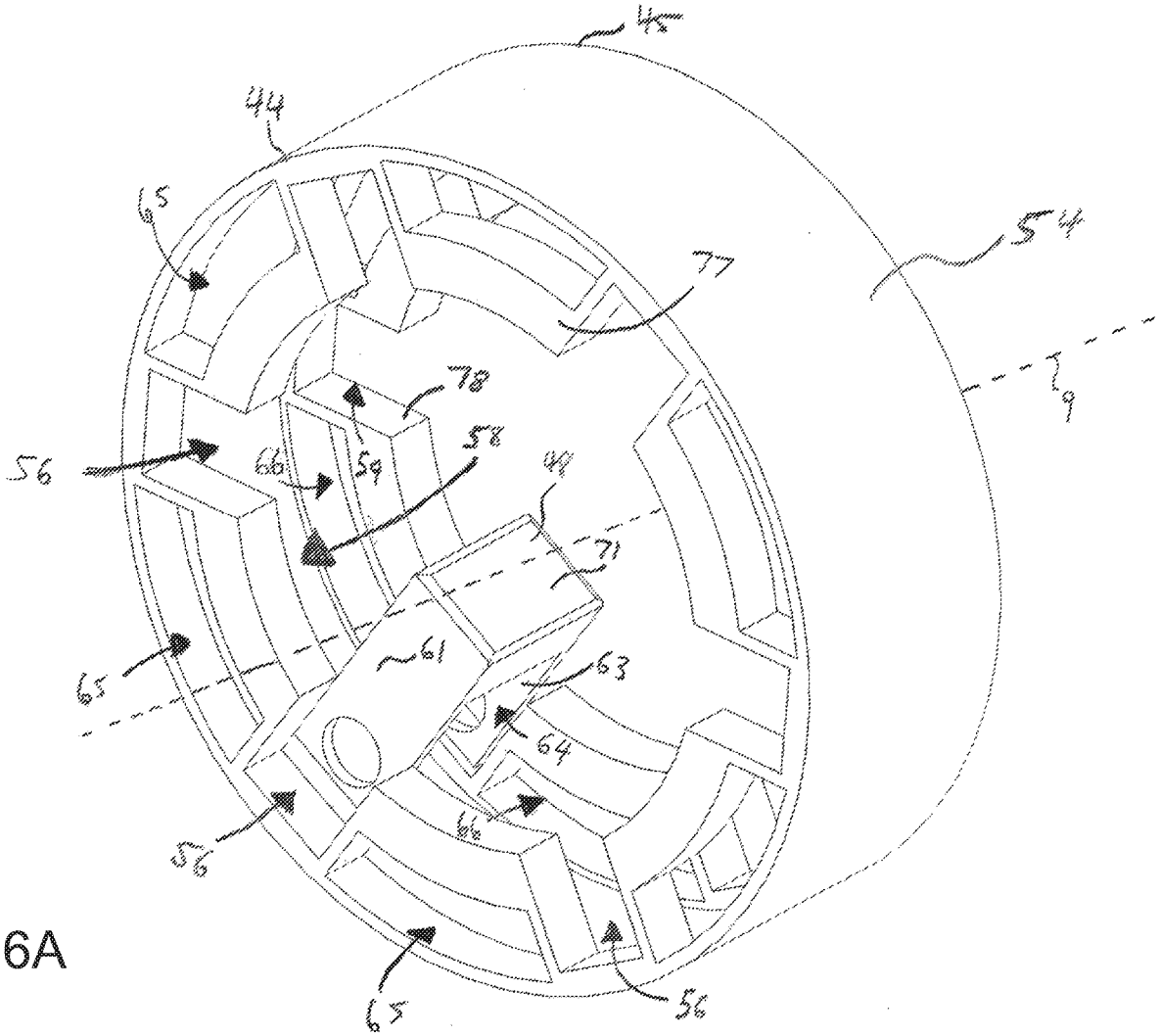
FIG. 6A is a perspective view of a frame and a jaw of the adjustable gripping tool of FIG. 1A in accordance with the present disclosure.

In one embodiment, frame 54 is configured to slidably retain cam disc 52 and jaws 48. For example, referring to FIG. 6A, frame 54 is shown in accordance with the present disclosure. Frame 54 includes sides 44 and 45 and an aperture or opening 79 (where opening 79 is shown in FIG. 5A). A plurality of extension members 77 are coupled to an inner circumference of side 44 of frame 54. Also, a plurality of corresponding extension members 78 are coupled to an inner circumference of side 45 of frame 54. It is to be appreciated that for each extension member 77 included on side 44 frame 54, a corresponding extension member 78 is also included on side 45 of frame 54. Each of extension members 77, 78 extend radially toward axis 9 from the inner circumference of frame 54. Between extension members 77 and 78, a circular slot 58 is formed. Each extension member 77 includes a curved or semi-circular slot 65 and each extension member 78 includes a corresponding curved or semi-circular slot 66. Between adjacent extension members 77, slots 56 are formed and between adjacent extension members 78, corresponding slots 59 are formed. As shown in FIG. 6A, each of slots 56, 59 are aligned in a radial direction toward axis 9.

Each slot 56 and corresponding slot 59 of frame 54 is configured to slidably retain a jaw 48 such that each jaw 48 may only slide in a linear radial direction A (shown in FIG. 6B) toward axis 9 or in a linear radial direction opposite to direction A away from axis 9 to increase or decrease the diameter of opening 11. Circular slot 58 is configured to slidably retain cam disc 52. For example, referring to FIGS. 6B and 6C, cam disc 52 is shown in slot 58.

Figure 6B:
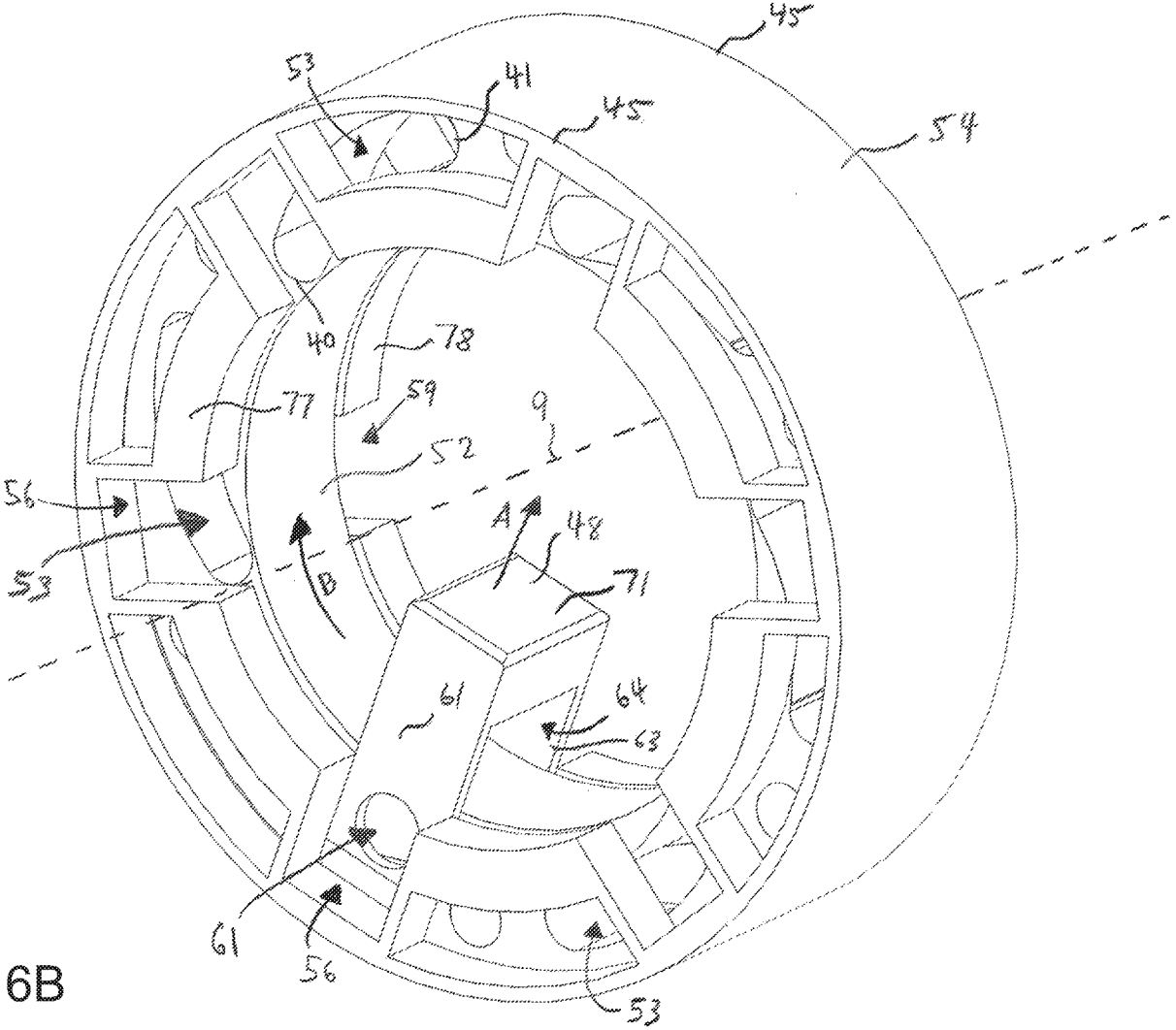
FIG. 6B is a perspective view of the frame and jaw of FIG. 6B and a cam disc of the adjustable gripping tool of FIG. 1A in accordance with the present disclosure.
Figure 6C:
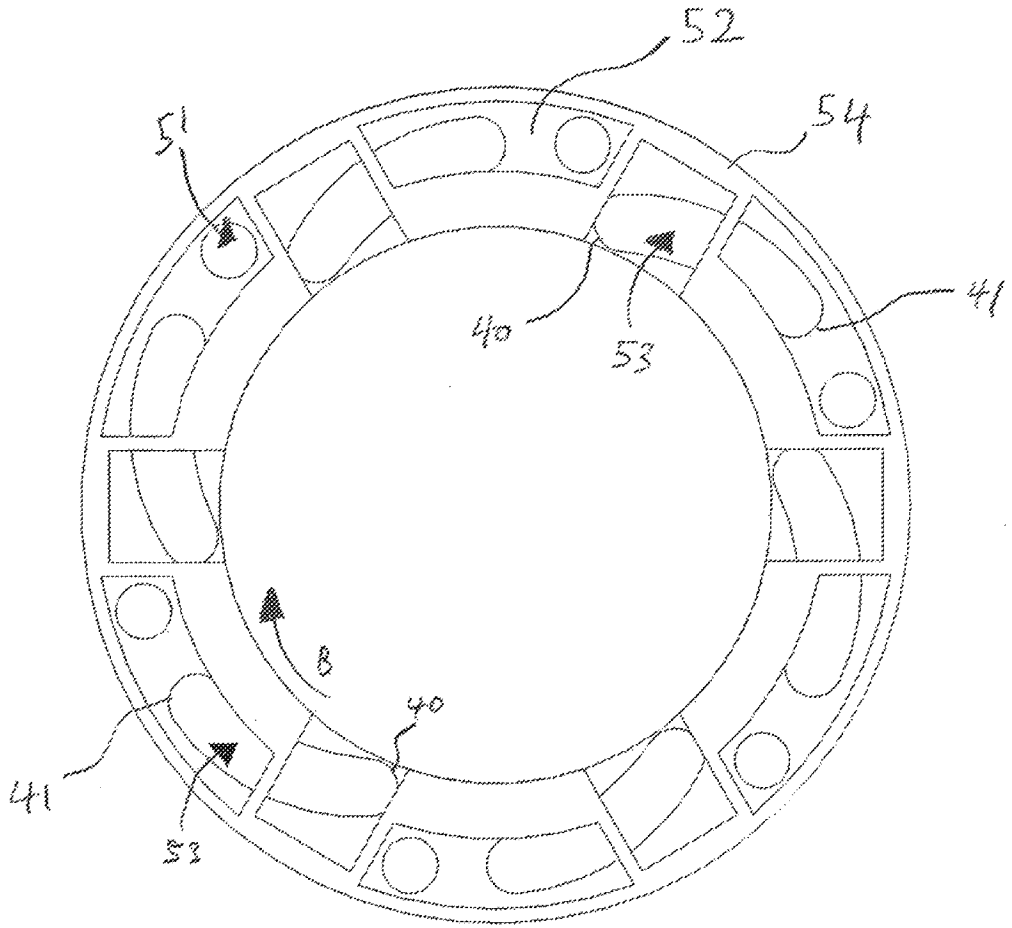
FIG. 6C is a front view the frame and cam disc of the adjustable gripping tool of FIG. 1A in accordance with the present disclosure.

As shown in FIGS. 6A, 6B, an end of each jaw 48 includes a pair of legs 61, 63 that define a slot 64, where legs 61, 63 are disposed on either side of cam disc 52 such that slot 64 receives a portion of cam disc 52, as shown in FIG. 6B. Each jaw 48 includes a pair of apertures 60, 62, where leg 61 includes aperture 60 and leg 63 includes aperture 62. As shown in FIGS. 5A, 5B, and 6C, cam disc 52 includes a plurality of cam or guide slots 53. Each slot 53 has a first end 40 and a second end 41. The first end 40 is disposed closer to axis 9 than the second end 41. In one embodiment, slot 53 is curved. Each pair of apertures 60, 62 of each jaw 48 is configured to align with a corresponding slot 53 of cam disc 52, such that, a rivet 50 is inserted into slot 53 and each of apertures 60 and 62 (as best seen in FIG. 1) to couple each jaw 48 to cam disc 52. It is to be appreciated that in one embodiment, each rivet 50 is made of an aluminum, such as, but not limited to, aluminum 5056 that is die casted.

Referring to FIG. 6B, cam disc 52 is slidably mounted in slot 58 of frame 54 such that cam disc 52 may be rotated relative to frame 54 about axis 9 in a direction B or in a direction opposite to direction B within slot 58. As cam disc 52 is rotated relative to frame 54, rivet 50 slides within slot 53. The distance between any given point within slot 53 and the axis 9 decreases as rivet 50 slides from end 41 to end 40 of slot 53. Furthermore, the distance between any given point within slot 53 and the axis 9 increases as rivet 50 slide from end 40 to end 41 of slot 53. Since each jaw 48 is confined to a pair of corresponding slots 56, 59 and can only slide in a radial direction toward longitudinal axis 9 or away from longitudinal axis 9, as cam disc 52 is rotated, rivet 50 is caused to slide through slot 53. As rivet 50 slides through slot 53, jaw 48 is caused to slide within slot 56 toward axis 9 or away from axis 9 (i.e., in direction A or opposite to direction A) depending on the position of rivet 50 within slot 53. For example, referring to FIGS. 6B and 6C, when cam disc 52 is rotated in a direction B relative to frame 54, rivet 50 slides toward end 40 of slot 53 and is caused to advance toward axis 9 (i.e., in direction A). As rivet 50 is advanced toward axis 9, jaw 48 is also caused to slidably advance within slots 56, 59 toward axis 9, reducing the diameter of opening 11. Alternatively, when cam disc 52 is rotated in a direction opposite to direction B relative to frame 54, rivet 50 slides toward end 41 of slot 53 and jaw 48 is caused to advance retract from axis 9 (i.e., in direction opposite to A). As rivet 50 is advanced away from axis 9, jaw 48 is also caused to slidably retract within slots 56, 59 away axis 9, enlarging the diameter of opening 11.

Figure 9A:
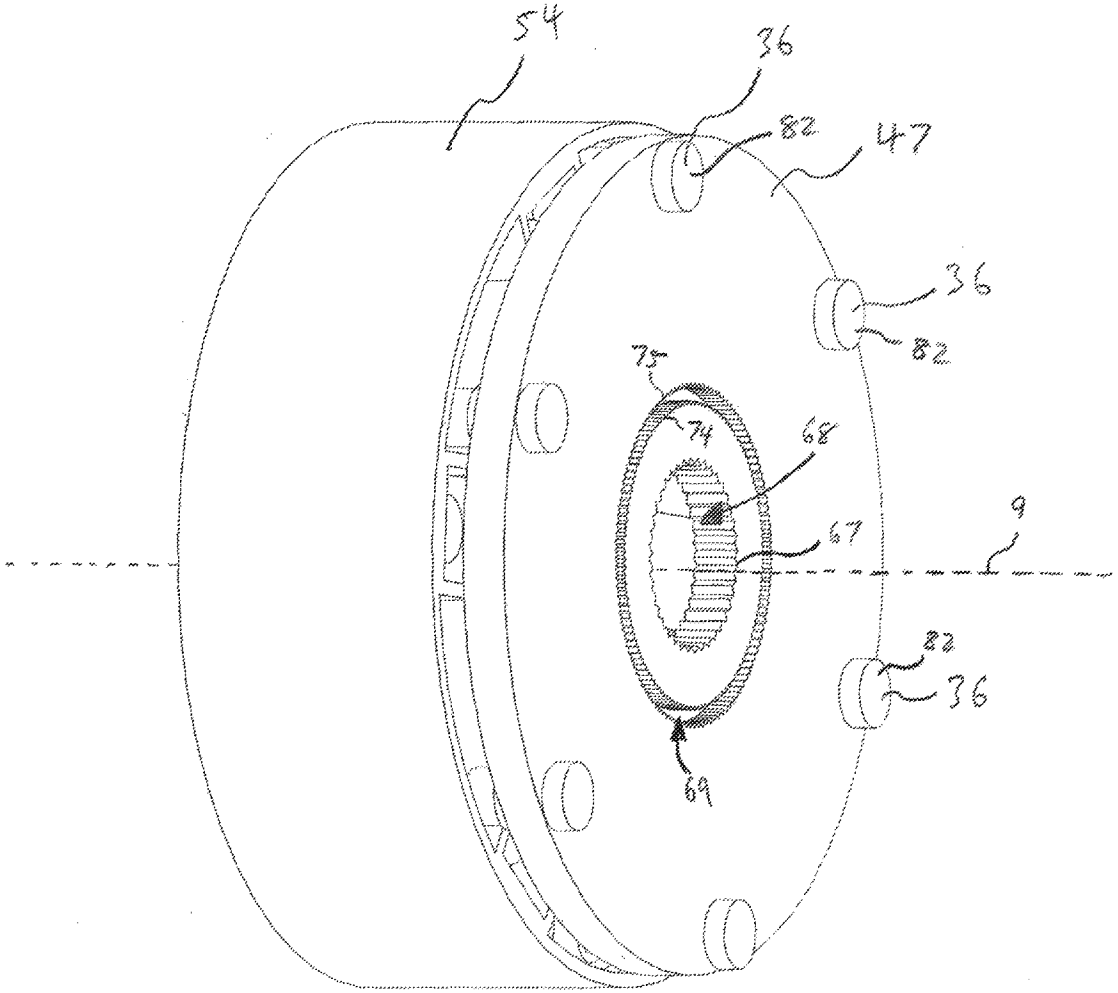
FIG. 9A is a perspective view of a portion of the adjusting assembly in accordance with the present disclosure.
Figure 9B:
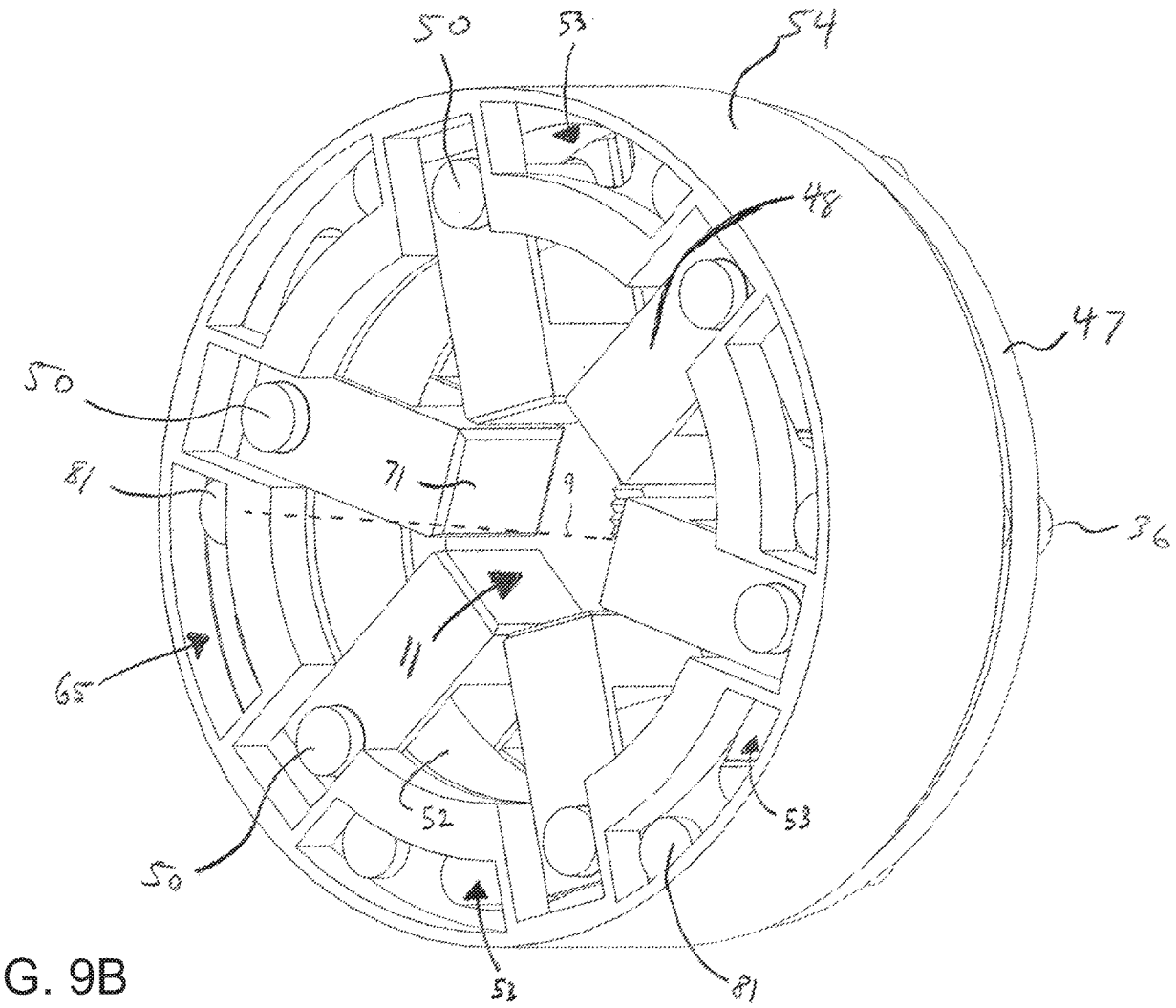
FIG. 9B is another perspective view of a portion of the adjusting assembly in accordance with the present disclosure.

As shown in FIGS. 6A and 6B, a first end of each jaw 48 (i.e., the end including apertures 61, 63) is coupled to cam disc 52 via rivet 50. A second end (opposite to the first end) of each of jaw 48 includes a gripping or engaging surface 71. As best seen in FIG. 9B, when each of the plurality of jaws 48 are disposed in a respective slot pairing 56, 59 and coupled to cam disc 52, the collective gripping surfaces 71 define an opening 11. The rotation of cam disc 52 in direction B (shown in FIGS. 6B and 6C) causes each of the plurality of jaws 48 to converge toward each other and axis 9 to decrease the diameter of opening 11. Alternatively, the rotation of cam disc 52 in direction opposite to direction B causes each of the plurality of jaws 48 diverge away from each other and axis 9 to increase the diameter of opening 11. In this way, after a work piece is inserted into opening 11, cam disc 52 may be appropriately rotated to cause jaws 48 to converge onto the work piece and grip the work piece with gripping surfaces 71 by adjusting the diameter of opening 11 appropriately. As will be described below, cam disc 52 is coupled to disc 47, such that, the rotation of disc 47 causes cam disc 52 to also be rotated.

Referring again to FIG. 6A, as described above, frame 54 includes one or more slots 65 on one side 44 of frame 54 that align with one or more slots 66 on an opposite side 45 of frame 54. Each pair of slots 65, 66 align to form a piston slot configured to receive a corresponding piston 36. Pistons 36 are used to couple disc 47 to cam disc 52 and frame 54, as shown in FIG. 4. It is to be appreciated that in one embodiment, each piston 36 is made of an aluminum, such as, but not limited to, aluminum 5056 that is die casted.

Figure 7A:
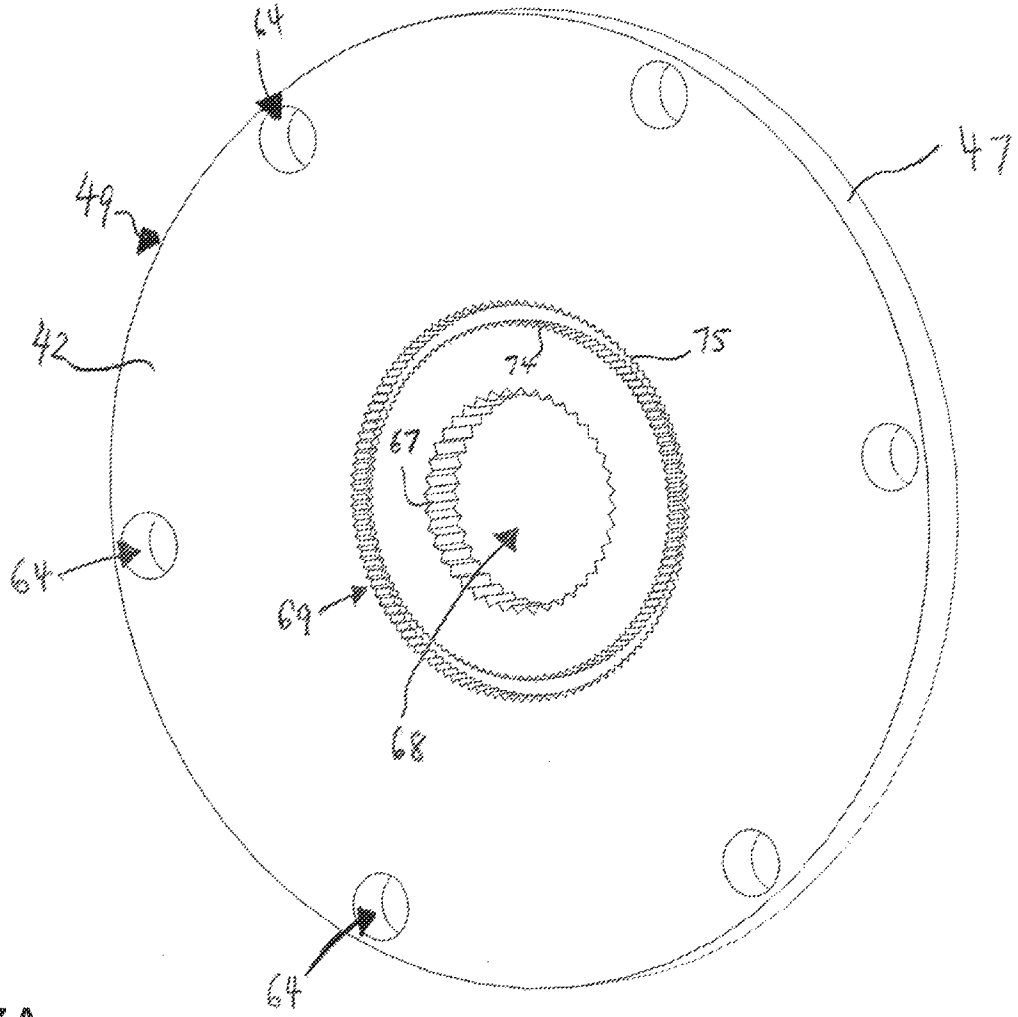
FIG. 7A is a perspective view of a disc of the adjustable gripping tool of FIG. 1A in accordance with the present disclosure.
Figure 7B:
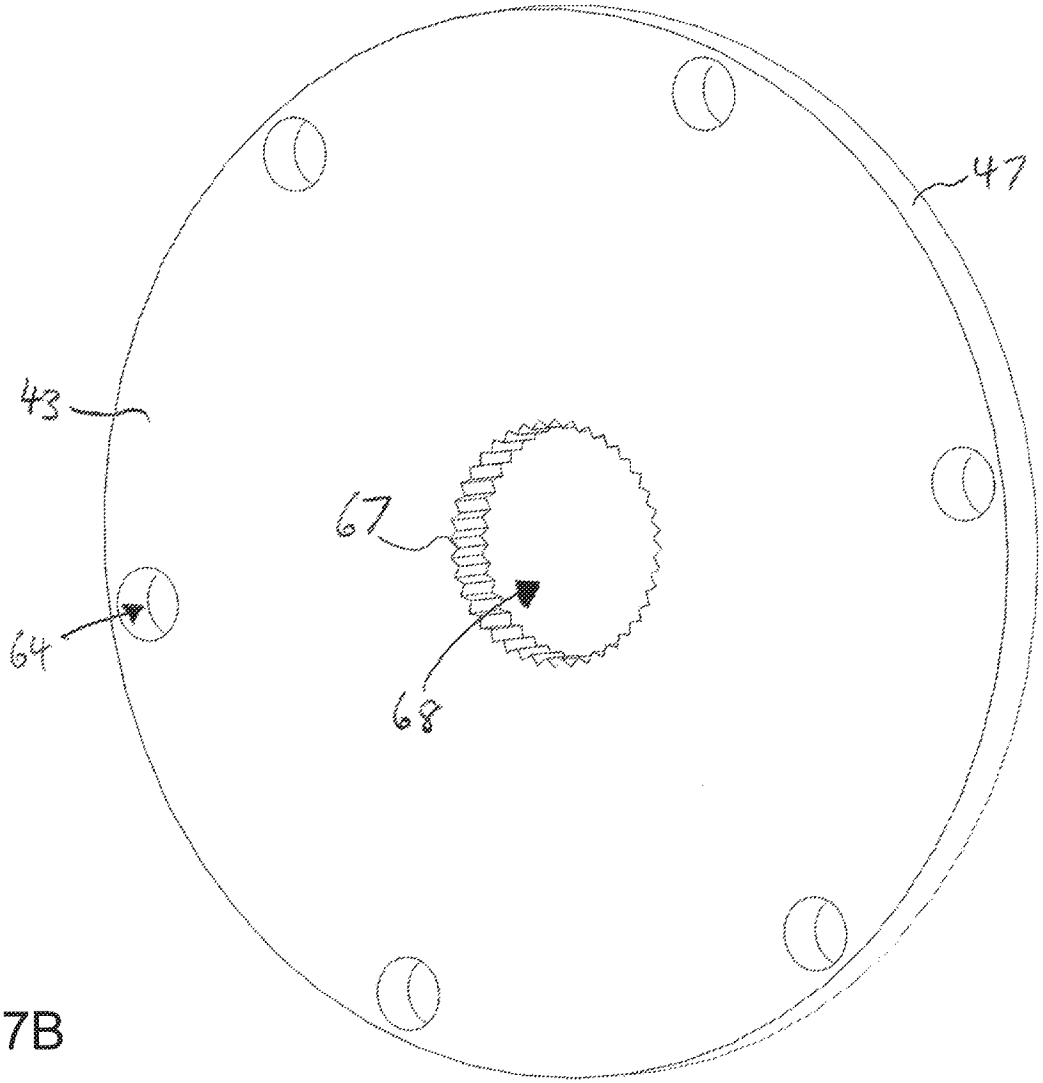
FIG. 7B is a perspective view of an opposite side the disc of FIG. 7A in accordance with the present disclosure.

Referring to FIGS. 7A and 7B, perspective views of disc 47 are shown in accordance with the present disclosure, where FIG. 7A shows side 42 of disc 47 and FIG. 7B shows an opposite side 43 of disc 47. Disc 47 includes a plurality of apertures 64 approximately equidistantly spaced near the periphery or outer circumference 49 of disc 47. Each aperture is configured to receive a corresponding piston 36 to couple disc 47 to cam disc 52. Side 42 of disc 47 includes a gear slot 69, a plurality of gear teeth 67, and an aperture 68 defined by gear teeth 67. Gear teeth 67 are oriented in a radial direction toward the center of disc 47. It is to be appreciated that gear slot 69 is configured to receive a gear ring, as will be described in greater detail below. In one embodiment, gear slot 69 is defined by a first set of gear teeth 75 oriented toward the center of disc 47 and a second set of gear teeth 74 oriented away from the center of disc 47, where gear teeth 74, 75 are configured to face each other. Also, it is to be appreciated that, in one embodiment, disc 47 is made of a steel, such as, but not limited to, AISI 4140 steel.

Figure 8A:
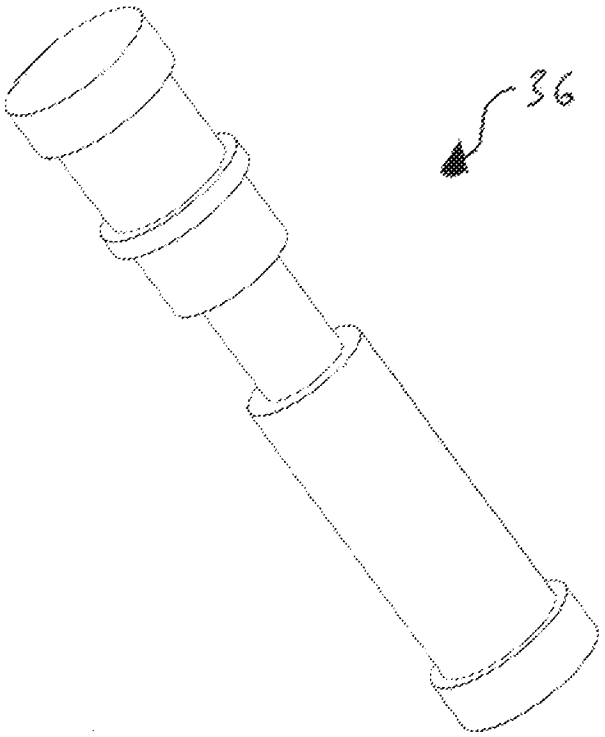
FIG. 8A is a perspective view of a piston assembly of the adjustable gripping tool of FIG. 1A in accordance with the present disclosure.
Figure 8B:
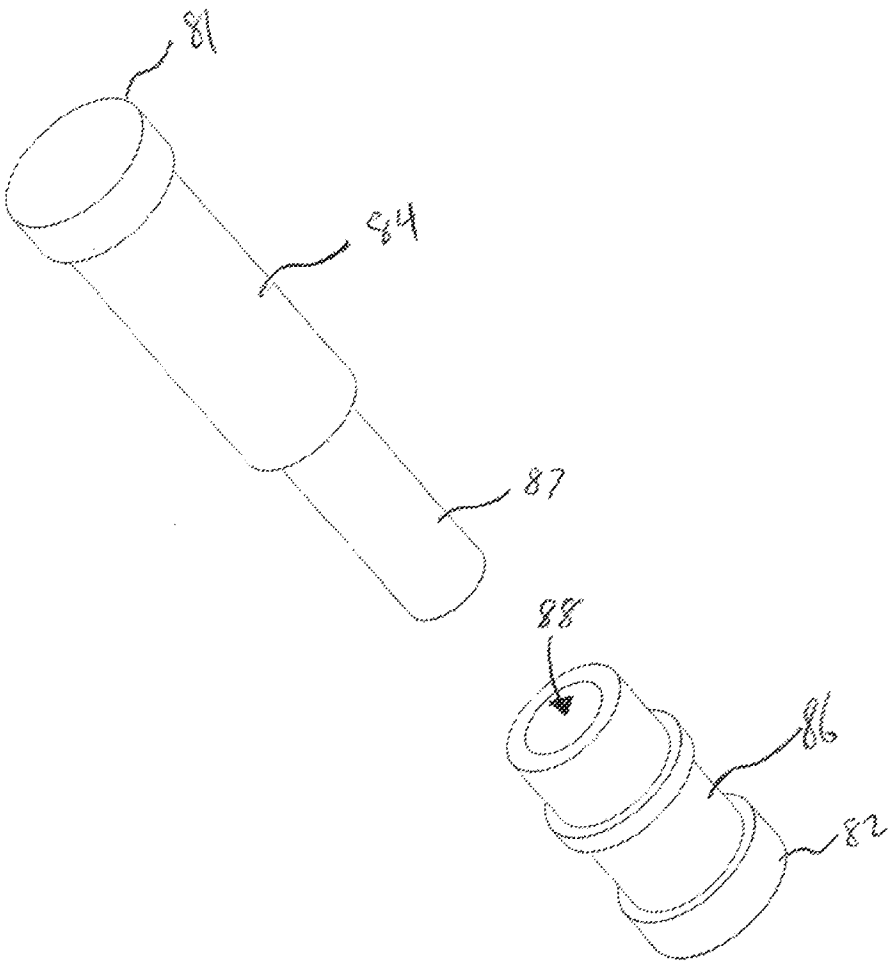
FIG. 8B is an exploded view of the piston assembly of FIG. 8B in accordance with the present disclosure.

Referring to FIGS. 8A and 8B, a perspective views of piston 36 is shown in FIG. 8A and an exploded perspective view of piston 36 is shown in accordance with the present disclosure. As shown in FIG. 8B, piston assembly 36 includes a male half 84 and a female half 86. The male half 84 includes a projection 87 configured to be received by a cavity 88 of female half 86. It is to be appreciated that cavity 88 includes a spring (not shown) disposed in the interior of cavity 88 that is configured to bias male half 84 away from female half 86. In this way, each piston 36 is compressible and depressible to bring ends 81 and 82 of each piston 36 together or apart. It is to be appreciated, that although not shown, projection 87 and cavity 88 are configured such that halves 84, 86 cannot be completely separated (i.e., a portion of projection 87 always remains inserted within cavity 88).

To couple cam disc 52 to disc 47, the male half 84 of each piston 36 is disposed through a corresponding aperture 51 of cam disc 52 and a corresponding pairing of slot 65, 66 of frame 54 such that each end 81 is coupled to cam disc 52. Furthermore, the female half 86 of each piston 36 is disposed through a corresponding aperture 64 of disc 47 such that end 82 is coupled to disc 47. For example, referring to FIGS. 9A and 9B, perspective views of disc 47 coupled to cam disc 52 via pistons 36 are shown in accordance with the present disclosure. As shown in FIG. 9A, each male half 84 of a piston 36 is disposed through respective slot pairing 65, 66 and apertures 51 such that end 81 is in slot 65. As shown in FIG. 9B, each female half 86 of a piston 36 is disposed through a respective aperture 64 (where aperture 64 is shown in FIG. 7A).

It is to be appreciated that disc 52 and disc 47 are coupled such that when disc 47 is rotated with respect to frame 54 (i.e., without rotating frame 54), disc 52 rotates within slot 58 in unison with disc 47. Since each piston 36 is disposed through a respective slot pairing 65, 66, the ends of slots 65, 66 limit the range of the rotational motion of discs 47 and 52 with respect to frame 54. Therefore, the distance between ends of slots 65, 66 limit the radial distance that jaws 48 can travel toward or away from axis 9. Furthermore, the distance between ends 40, 41 of slots 53 also limit the radial distance that jaws 48 can travel toward or away from axis 9. When opening 11 is adjusted by rotating discs 47 and 52 (without rotating frame 54) to converge surfaces 71 of jaws 48 onto a work piece, such that jaws 48 cannot be advanced radially toward axis 9 any further (i.e., because the work piece prevents jaws 48 from converging any further), the rotation discs 47 and 52 will also cause frame 54 to rotate in unison with discs 47 and 52 to impart work onto a work piece.

Since, pistons 36 are compressible and depressible, as described above, disc 47 is slidable along axis 9 in a direction toward or away from frame 54. As will be described in greater detail below, when disc 47 slides or is advanced in a direction toward frame 54, ratcheting assembly 70 is coupled to disc 47, such that, ratcheting assembly 70 controls the rotations of disc 47. When ratcheting assembly 70 is coupled to disc 47, gripping tool 10 is in a ratcheting configuration. Alternatively, when disc 47 slides or is retracted in a direction away from frame 54, ratcheting assembly 70 is decoupled from (or disengages) disc 47 and instead adjusting disc 28 is coupled to disc 47, such that, disc 28 controls the rotations of disc 47. When disc 28 is coupled to disc 47, gripping tool 10 is in an adjusting configuration. Disc 28 and ratcheting assembly 70 are each described in greater detail below.

Figure 10A:
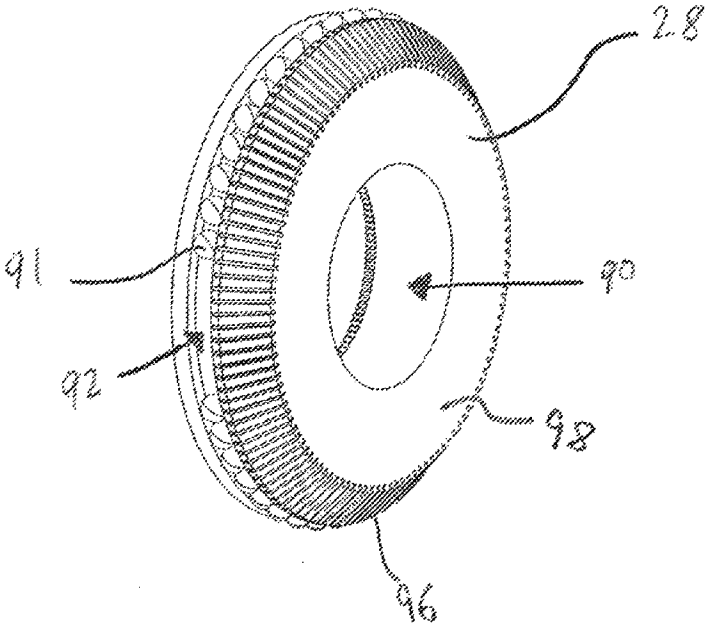
FIG. 10A is a front perspective view of another disc of the adjustable gripping tool of FIG. 1A in accordance with the present disclosure.
Figure 10B:
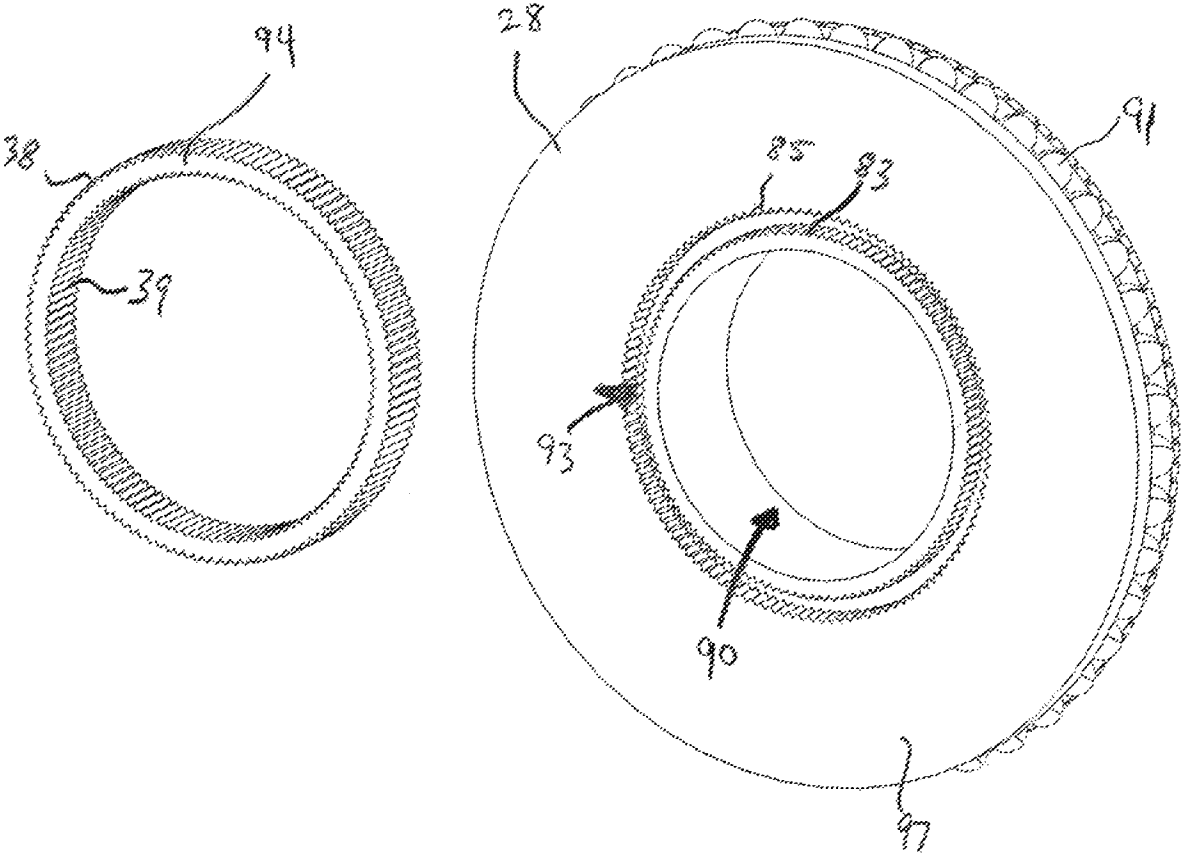
FIG. 10B is rear perspective view of the disc of FIG. 10A in accordance with the present disclosure.

Referring to FIGS. 10A and 10B perspective views of disc 28 are shown in accordance with the present disclosure. As shown in FIG. 10A, side 98 of disc 28 includes a plurality of beveled gear teeth 96, aperture 90, and a slot 92. Slot 92 is configured to receive ball bearings 91. As shown in FIG. 10B, side 97 of disc 28 also includes a gear slot 93 configured to receive a portion of circular gear 94. Gear ring 94 is shown disposed in gear slot 93 in FIG. 10D. In one embodiment, gear slot 93 is defined by a first set of gear teeth 85 oriented in a radial direction toward the center of disc 28 and a second set of gear teeth 83 oriented in a radial direction away from the center of disc 28, where gear teeth 83, 85 are configured to face each other. Circular gear or gear ring 94 includes a first set of gear teeth 39 in an inner circumference of gear ring 94 and a second set of gear teeth 38 in an outer circumference of the gear ring 94. When circular gear 94 is received by gear slot 93, teeth 38 mate with teeth 85 and teeth 39 mate with teeth 83. It is to be appreciated that in one embodiment, disc 28 may be made of a steel, such as, but not limited to, AISI 4140 steel.

Figure 10C:
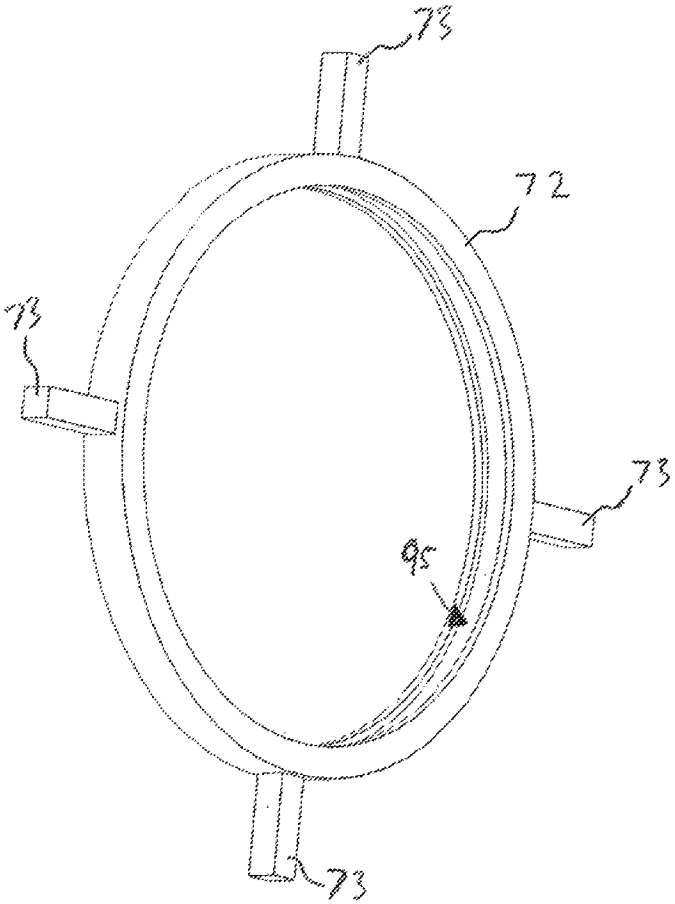
FIG. 10C is a perspective view of a ring of the adjustable gripping tool of FIG. 1A in accordance with the present disclosure.
Figure 10D:
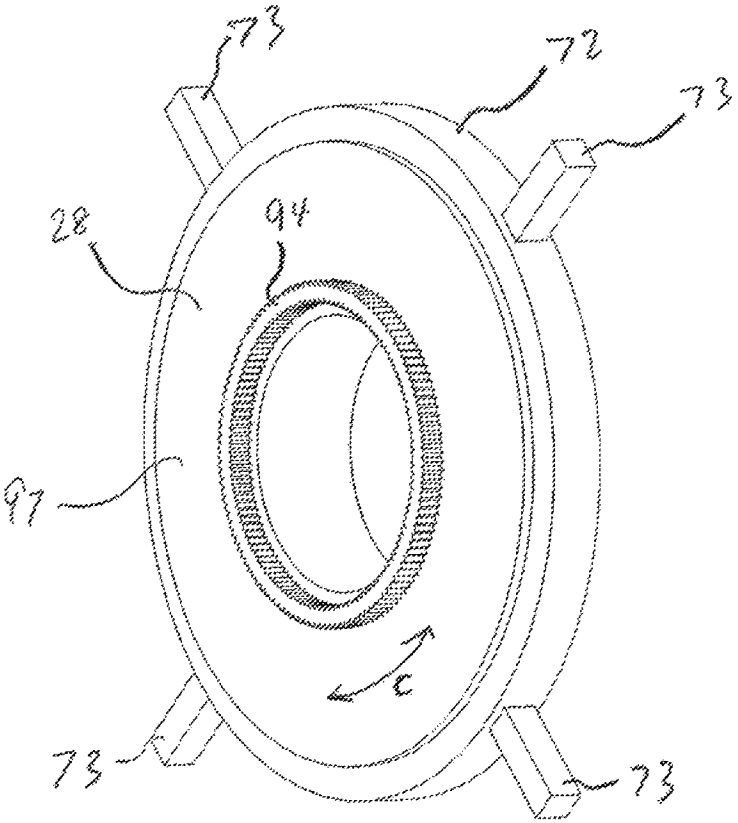
FIG. 10D is a perspective view of the disc of FIG. 10A coupled to the ring of FIG. 10C in accordance with the present disclosure.

Referring to FIG. 10C, a disc mounting ring 72 is shown in accordance with the present disclosure. Ring 72 includes projections 73 and slot 95. Slot 95 is disposed on an inner circumference of ring 72. Each projection 73 is configured to be disposed in a respective aperture 205 (shown in FIGS. 2A and 2B) of wrench head 18 to mount ring 72 to the interior 204 of wrench head 18. Slot 95 is configured to receive ball bearings 91 to slidably couple disc 28 to ring 72. Referring to FIG. 10D, disc 28 is shown coupled to ring 72 in accordance with the present disclosure. Ball bearings 91 are disposed is both slots 92 and 95, such that, disc 28 can rotate freely within ring 72 relative to wrench head 18 as indicated by arrow C in FIG. 10D.

A portion of circular gear 94 protrudes from surface 97 of disc 28 and is configured to be received by gear slot 69 of disc 47 to couple disc 28. In this way, when disc 47 slides along axis 9 in a direction away from frame 54 and toward disc 28, disc 47 is coupled to disc 28 (i.e., achieving an adjusting configuration). While disc 28 is coupled to disc 47, the rotation of disc 28 also rotates disc 47 (thereby also rotating disc 52 and advancing and retracting jaws 48 radially with respect to axis 9). As shown in FIG. 4, the gear teeth of bevel gear 17 of adjusting member 22 is coupled to gear teeth 96 of disc 28. In this adjusting configuration, bolt 15 may be rotated to rotate disc 28, which will cause disc 42 to be rotated to adjust the diameter of opening 11 via the radial advancement or retraction of jaws 48 relative to axis 9.

Figure 11A:
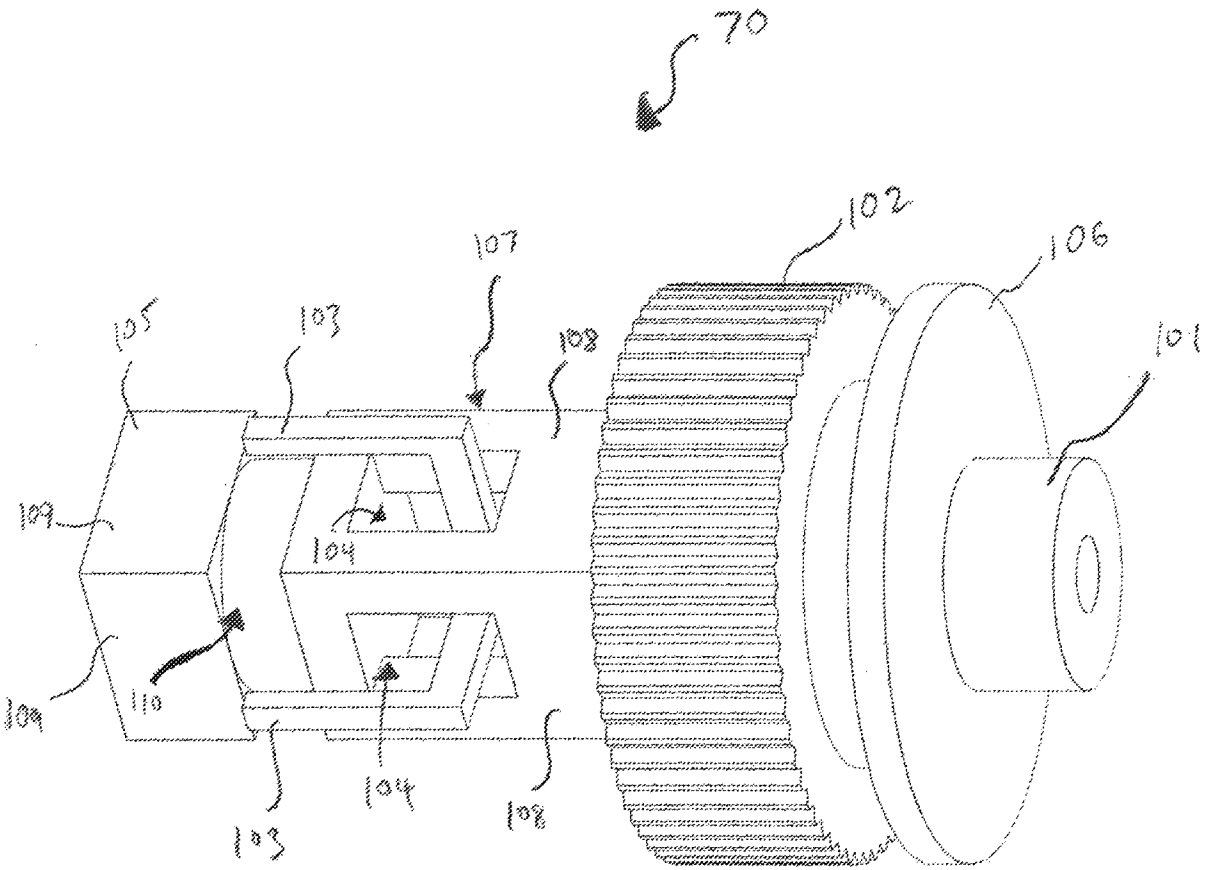
FIG. 11A is a perspective view of a ratcheting assembly of the adjustable gripping tool of FIG. 1A in accordance with the present disclosure.
Figure 11B:
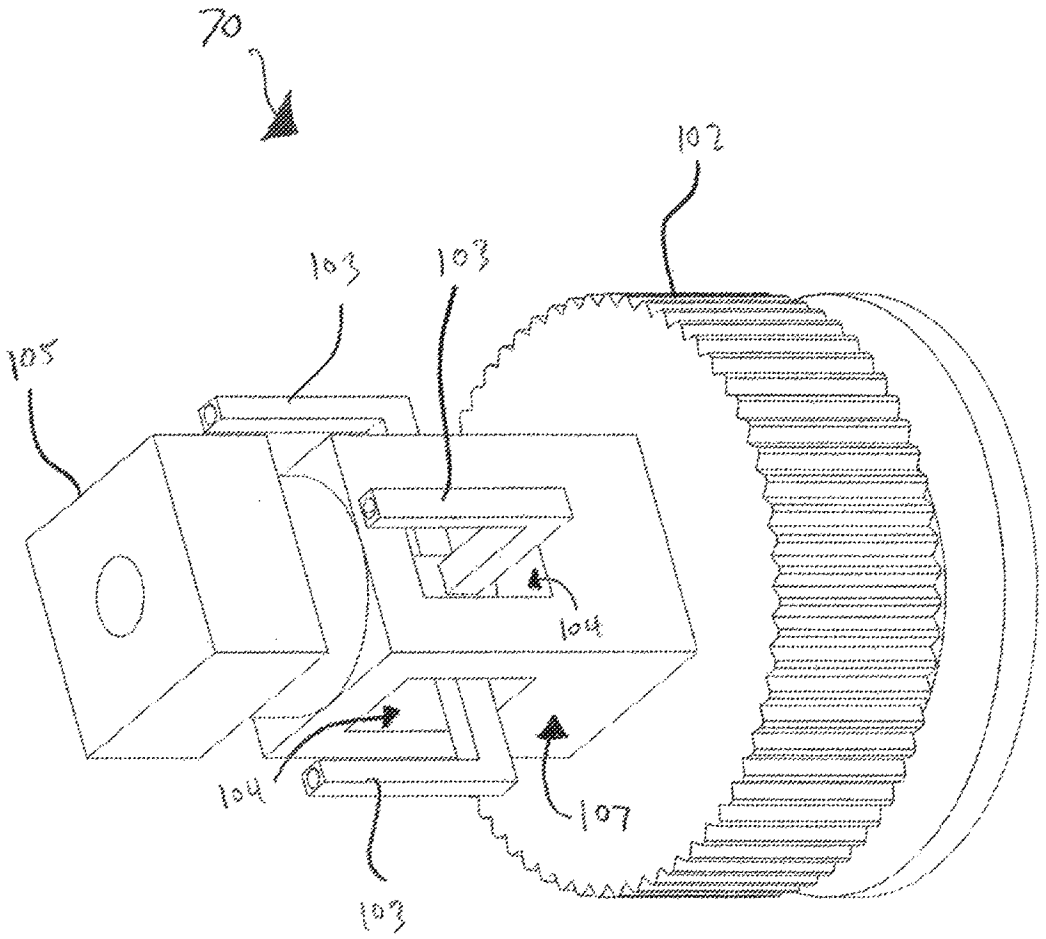
FIG. 11B is another perspective view of the ratcheting assembly of FIG. 11A in accordance with the present disclosure.

As shown in FIG. 4, a portion of ratcheting assembly 70 is shown disposed through aperture 90 of disc 28. Referring to FIGS. 11A and 11B, perspective views of ratcheting assembly 70 are shown in accordance with the present disclosure. Ratcheting assembly 70 includes a button 101, a mounting disc 106, and a main body or ratcheting assembly bolt 107. In one embodiment, the ratcheting assembly bolt 107 is configured in a generally rectangular shape including a plurality of flat surfaces 108 that each include an aperture 104 providing access to a channel disposed in ratcheting assembly bolt 107 (described below). A portion of an an arm or sliding member 103, generally configured in an L-shape, is disposed through each aperture 104. Ratcheting assembly bolt 107 also includes a bolt head 105 disposed at one end of ratcheting assembly bolt 107 and a gear 102 disposed at an opposite end of ratcheting assembly 107. Bolt head 105 includes four flat surfaces 109. Flat surfaces 108 and flat surfaces 109 are separated by a recess member 110.

Figure 11C:
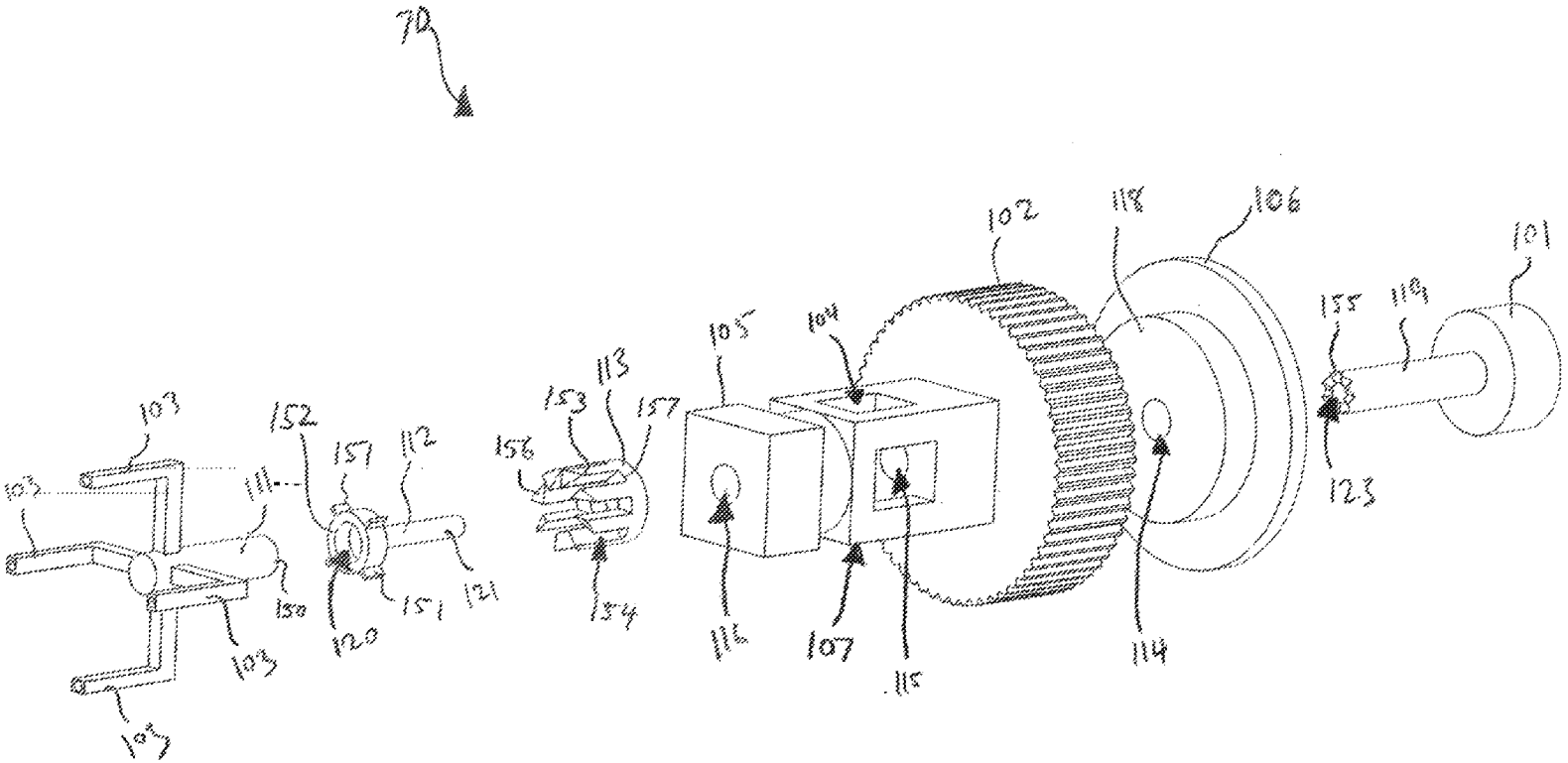
FIG. 11C is an exploded perspective view of the ratcheting assembly of FIG. 11A in accordance with the present disclosure.
Figure 11D:
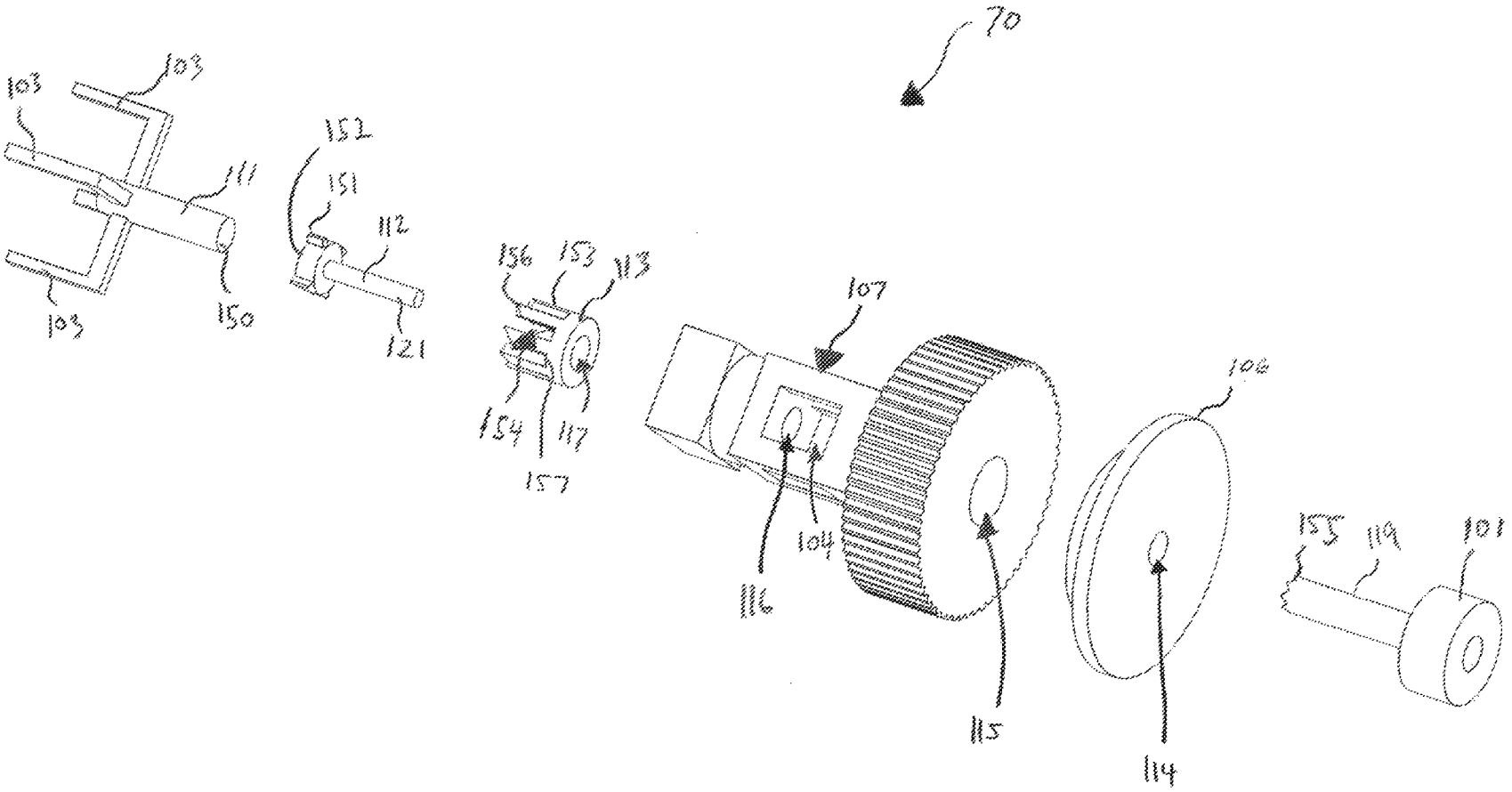
FIG. 11D is another exploded perspective view of the ratcheting assembly of FIG. 11A in accordance with the present disclosure.

Referring to FIGS. 11C and 11D, exploded perspective views of ratcheting assembly 70 are shown in accordance with the present disclosure. As shown in FIGS. 11C and 11D, ratcheting assembly 70 also includes a pin 111, a front cam 112, and a rear cam 113. Arms 103 are coupled to pin 111. An end 150 of pin 111 is disposed in a circular slot 120 of front cam 112, where circular slot 120 is included in a base 152 of front cam 112. Front cam 112 also includes a projection 121 extending from base 152 and a plurality of protrusions 151. Projection 121 is disposed through an aperture 117 of rear cam 113 and partially through a channel 116 of bolt head 105. Channel 116 extends to the interior of ratcheting assembly bolt 107. Also, gear 102 includes a channel 115 extending to the interior of ratcheting assembly bolt 107 and mounting disc 106 includes a channel 114. Mounting disc 106 also includes a cylindrical projection 118, where channel 114 extends from the side of mounting disc 106 including the cylindrical projection 118 to the opposite side of mounting disc 106. A projection 119 of button 101 is disposed through channels 114, 115, and partially through channel 116. Projection 119 includes a channel 123, where within channel 116, projection 121 is disposed in channel 123. Projection 119 is further disposed through aperture 117 of rear cam 113, such that an end 155 of projection 119 is coupled to base 152 of front cam 112.

Rear cam 113 includes a plurality of protruding members 153, each having slanted edges or ends 156. Cam 113 also includes slots 154 disposed between adjacent protruding members 153. As will be described in greater detail below, cams 112 and 113 are configured to interact to enable arms 103 achieve a forward position (i.e., in a direction along axis 9 toward frame 54) and a back position (i.e., in a direction along axis 9 away from frame 54) in response to button 101 being pressed.

As shown in FIG. 1B, mounting disc 106 is disposed on a rear surface 210 of wrench head 18, where button 101 is disposed on the surface of mounting disc 106 opposite to cylindrical projection 118. Cylindrical projection 118 is disposed through aperture 201 of wrench head 18.

In one embodiment, ratcheting assembly 70 is configured, such that, when button 101 is pressed in a direction toward mounting disc 106, arms 103 move independently of ratcheting assembly bolt 107 and in unison in a direction toward adjusting bolt head 105 along longitudinal axis 9 and are held in the advanced position. When button 101 is pressed a second time (i.e., while arms 103 are in the advanced position), arms 103 will come back to their original position (i.e., arms will move in unison in a direction toward gear 102). In one embodiment, springs (not shown) are coupled between each of arms 103 and disc 47 to bias arms 103 in a direction away from disc 47 and toward mounting disc 106.

Figure 11E:
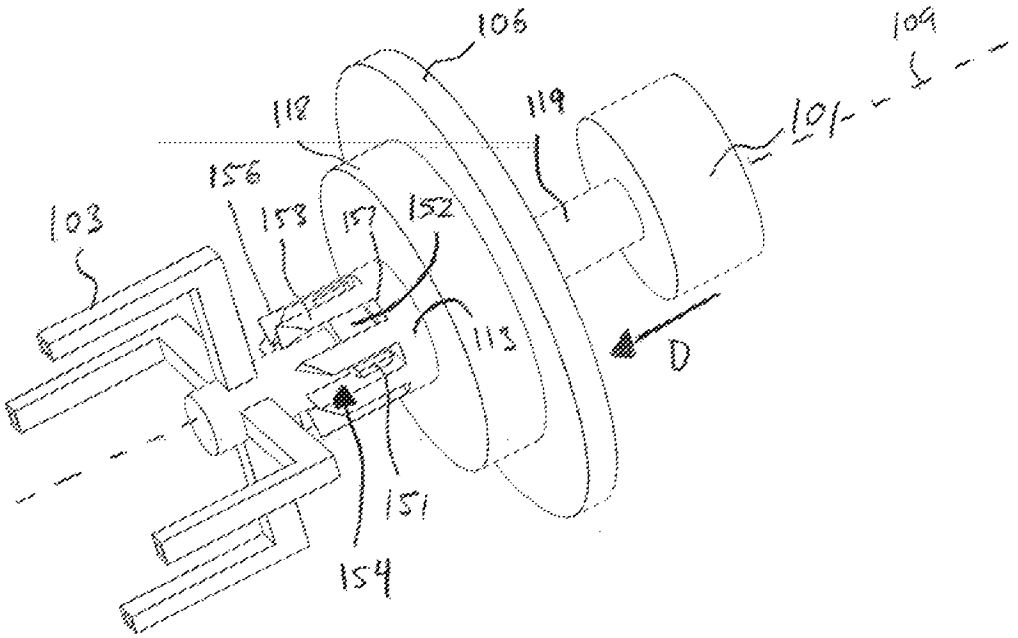
FIG. 11E-G are perspective views of the ratcheting assembly of FIG. 11A with a main body portion removed in accordance with the present disclosure.
Figure 11F:
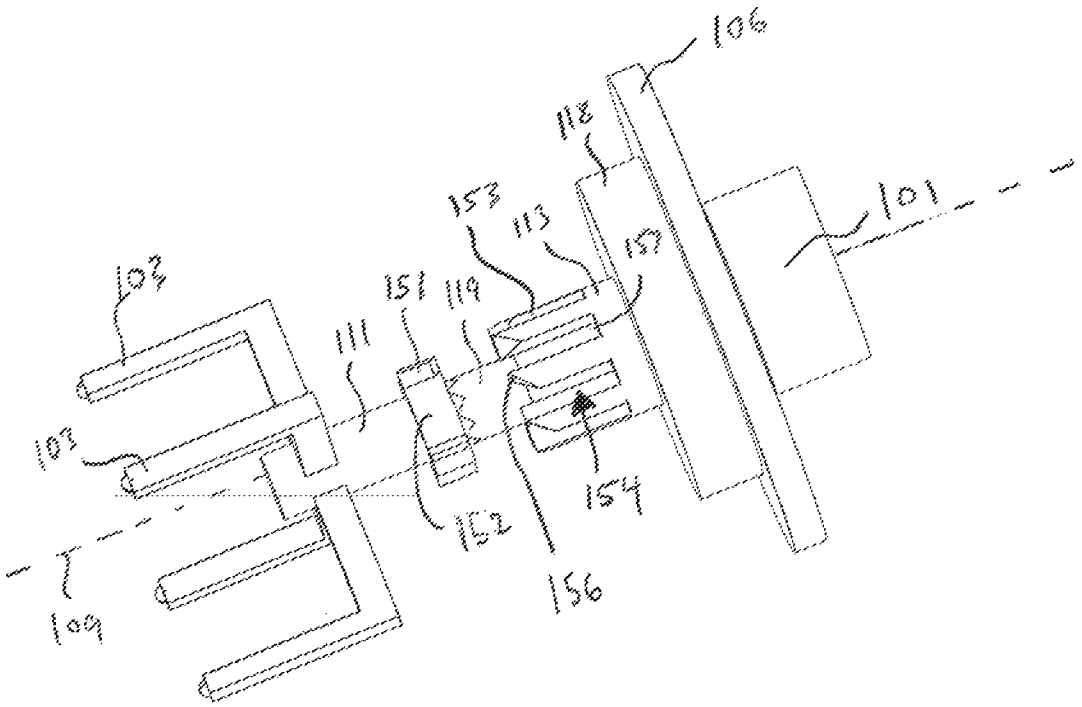
Figure 11G:
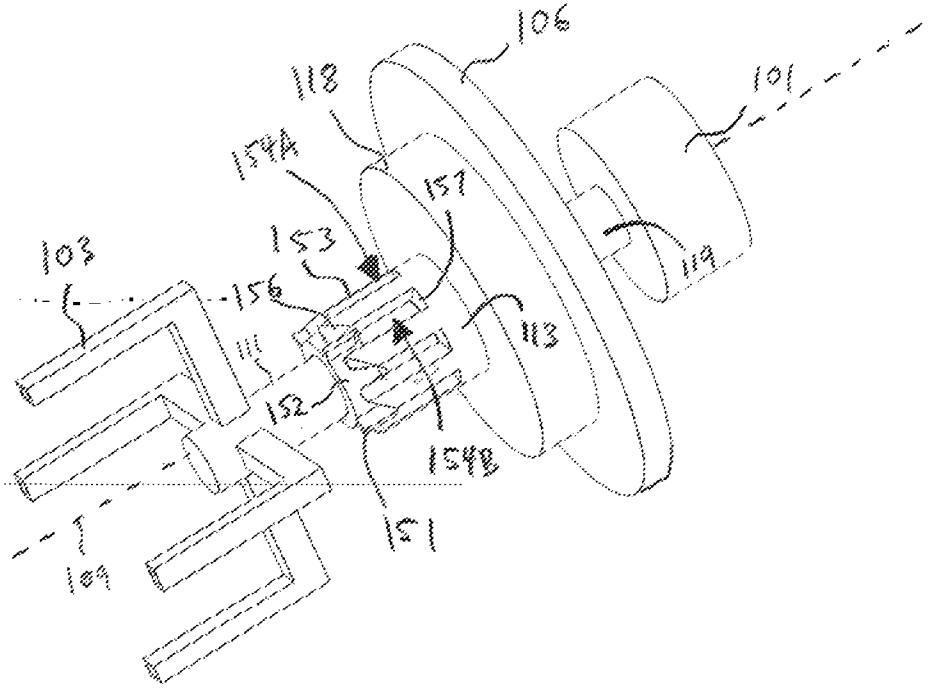

For example, referring to FIGS. 11E-G, perspective views of ratcheting assembly 70 are shown with ratcheting assembly bolt 107 removed. As shown in FIG. 11E, in a first position, base 152 of cam 112 is disposed between protruding members 153 such that protrusions 151 of cam 112 are disposed in slots 154 of cam 113. Springs disposed between arms 103 and disc 47 bias each arm 103 in a direction away from bolt head 105 and toward mounting disc 106, such that, protrusions 151 of cam 112 are forced toward ends 157 of slots 154. From this position, button 101 may be pressed in a direction D, as indicated in FIG. 11E, to advance each of arms 103 in a direction D. It is to be appreciated that when arms 103 are disposed in apertures 104, apertures 104 allow arms 103 to move freely along axis 9 toward or away from disc 47. When button 101 is pressed, projection 119 (which is coupled to base 152 of cam 112) slides within apertures 114 and 117 (shown in FIGS. 11A and 11B) to force cam 112 to slide in a direction D along axis 9, thus also forcing projection 111 and arms 103 to slide in a direction D.

After button 101 is pressed, base 157 of cam 112 is disposed passed slanted edges 156 of protruding members 153, as shown in FIG. 11F. As cam 112 slides in a direction D, the protrusions 151 of cam 112 come into contact with the slanted edges 157 of protruding members 153. The slanted edges 157 of cam 113 are configured such that protrusions 151 will follow the path of least resistance and rotate from a slot 154 that was previously occupied to an adjacent slot 154. As the springs disposed between arms 103 and disc 147 bias arms 103 toward mounting plate 106, protrusions 151 are forced into an adjacent slot 154 from the slot previously occupied, for example as shown in FIG. 11G, a protruding member 151 that previously occupied a slot 154A is forced toward an adjacent slot 154B. Cam 113 is configured such that every other adjacent slot 154 (e.g., slot 154B) and adjacent protruding members 153 is configured to not enable protrusions 151 to slide to the end 157 of slot 154. In this way, arms 103 are maintained or held in an advanced position along axis 9. For example, comparing FIGS. 11E and 11G, in FIG. 11G arms 103 are in an advanced position (i.e., further from mounting plate 106) relative to the position of the arms 103 in FIG. 11E (which are closer to mounting plate 106).

In this way, each time button 101 is pressed, base 157 of cam 112 is rotated and protrusions 151 will be disposed in an adjacent slot 154, such that, slide along axis 9 to an advanced position (as shown in FIG. 11G) and a retracted position (as shown in FIG. 11E).

It is to be appreciated that projection 111 is disposed in slot 120 of cam 112 such that projection 111 is ratable relative to each of the components of ratcheting assembly 70.

Figure 12:
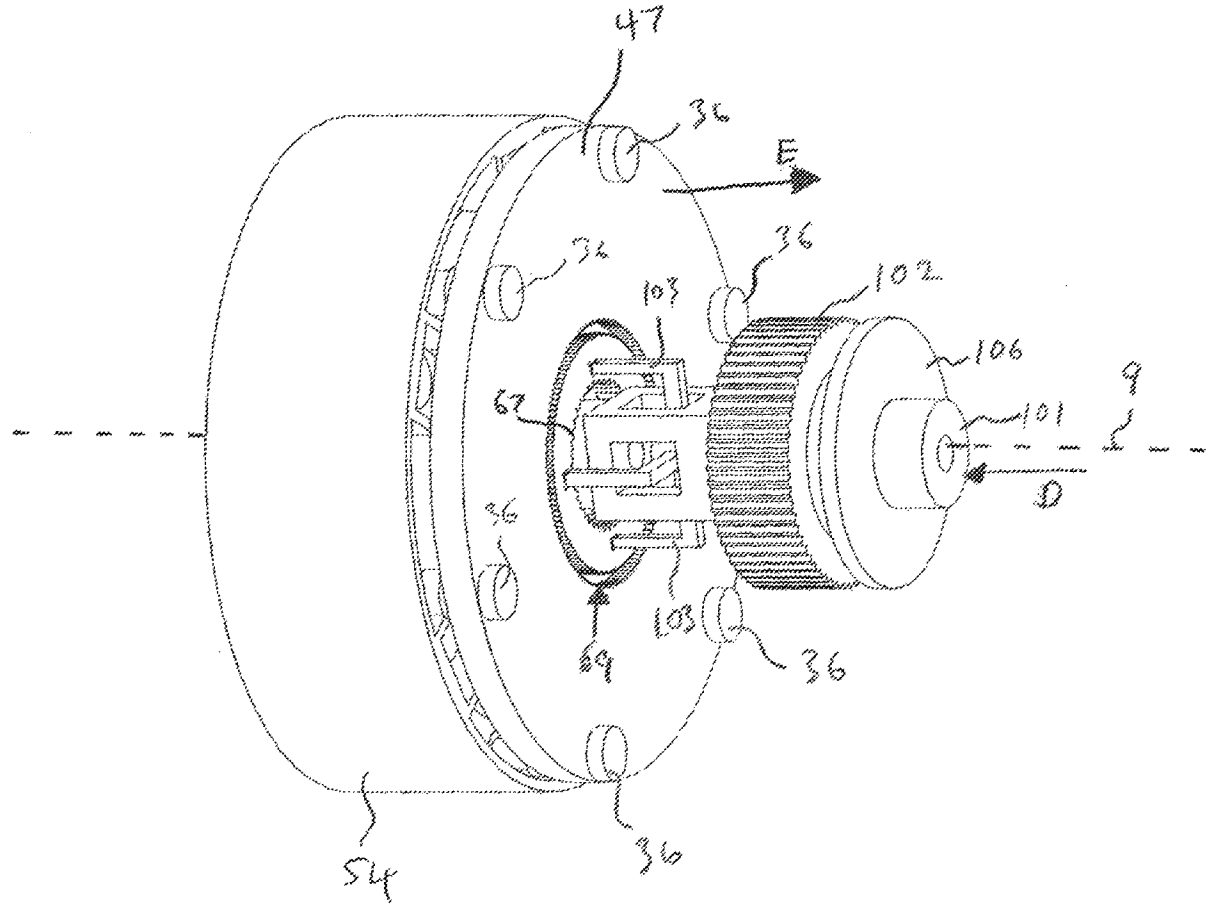
FIG. 12 is the adjusting assembly and the ratcheting assembly of the adjustable gripping tool of FIG. 1A in accordance with the present disclosure.

Referring to FIG. 12, ends of arms 103 of ratcheting assembly 70 are shown coupled to disc 47 with bolt head 105 disposed through aperture 68 of disc 47. As described above, when button 101 is pressed in a direction D (indicated in FIG. 12) along axis 9, arms 103 are advanced in a direction D toward disc 47, causing disc 47 to also be advanced in a direction D (i.e., toward frame 54). When disc 47 is advanced in a direction D, each piston assembly 36 will be compressed. When button 101 is pressed for a second time, arms 103 are retracted in a direction E, (i.e., opposite to C) and each piston assembly 36 will decompress and bias disc 47 in a direction E. It is to be appreciated that aperture 90 of disc 28 is configured such that ratcheting assembly 70 does not come into contact with disc 28.

When disc 47 is in a position biased away from frame 54, gear 94 is coupled to gear slot 69. In this way, when gear 94 is coupled to gear slot 69, bolt 15 can be rotated to rotate disc 28, which rotates circular gear 94, which, when in slot 69, causes disc 47 to rotate. It is to be appreciated that, in this position (i.e., gear 94 disposed in gear slot 69), gear 67 of disc 47 is disposed around recess member 110 of ratcheting assembly 70, such that, disc 47 may rotate freely without coming into contact or engaging bolt head 105 of ratcheting assembly 70. When gear 94 is coupled to gear slot 69 and bolt 15 is rotated causing disc 47 to rotate, disc 47 causes adjusting cam disc 52 to rotate (via pistons 36) in slot 58 of frame 54. The rotation of adjusting cam disc 52 causes rivets 50 to ride along slots 53 of cam disc 52. As best seen in FIG. 6C, each slot 53 is configured such that as rivet 50 slides along slot 53 from end 41 to 40 of slot 53, rivet 50 gradually gets closer or farther away longitudinal axis 9. When a rivet 50 gets closer or farther away to longitudinal axis 9, the corresponding jaw 48 coupled to the rivet 50 is advanced in slot 56 in a linear radial direction (do to the design of slot 56) toward the longitudinal axis 9 or away from the longitudinal axis 9. It is to be appreciated that the adjustable gripping tool of the present disclosure is configured such that the jaws 48 will each move in unison while being adjusted.

After the diameter of opening or area 11 is adjusted (by rotating bolt 15) to fit around a work piece (e.g., a nut or bolt), button 101 may be pressed to go from an adjusting configuration (i.e., where gear 94 is in gear slot 69) to a ratcheting configuration. When button 101 is pressed, as described above, arms 103 are advanced in a direction A (indicated in FIG. 12) and cause disc 47 to be advanced in a direction A toward frame 54. When disc 47 is advanced in a direction A, gear 94 is separated or removed from slot 69 and bolt head 105 engages or becomes coupled to gear 67. In this position, the rotation of bolt 105 does not rotate disc 47, since gear 94 is no longer coupled to slot 69. Instead the rotation of main body 107 (via the rotation of gear 102) controls the rotation of disc 47. It is to be appreciated that, in one embodiment, gear 67 includes square cuts spaced at very frequent increment around gear 67 (e.g., at 9-degree increments) to facilitate easy engagement of bolt head 105 and gear 67 for various alignments of bolt head 105 in relation to gear 67.

Figure 13:
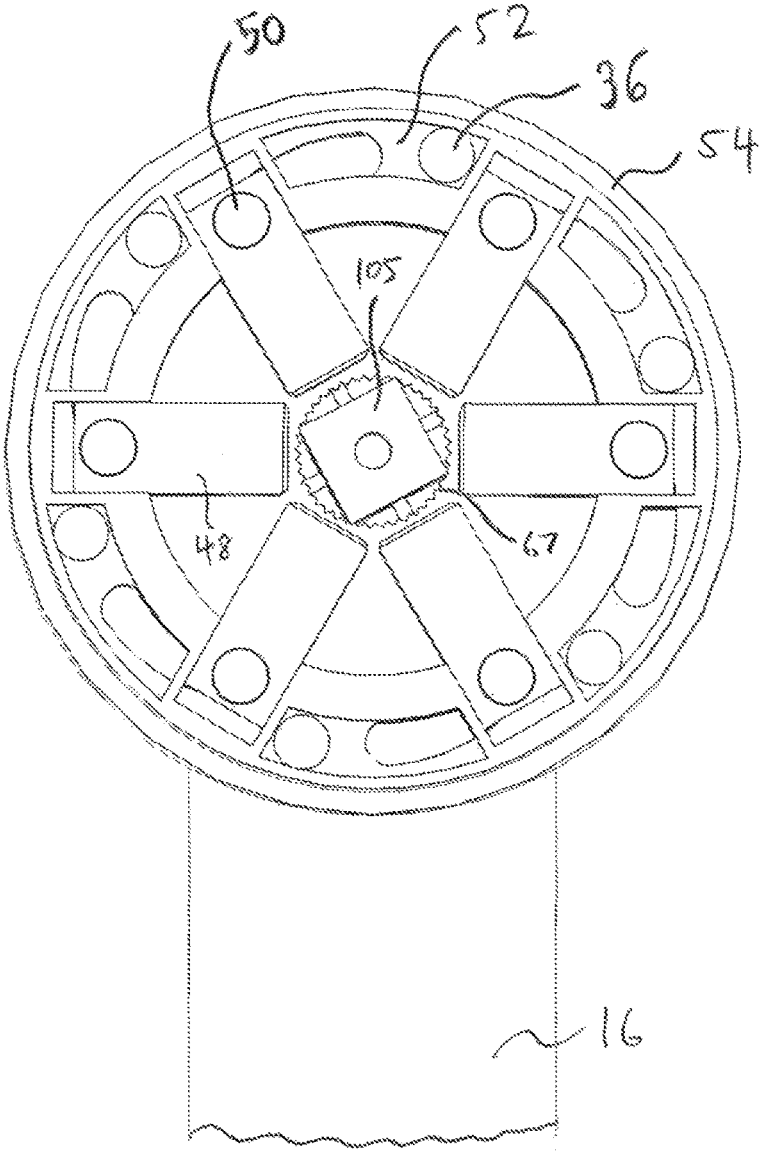
FIG. 13 is a partial front perspective view of the adjustable gripping tool of FIG. 1A in accordance with the present disclosure.

Referring to FIG. 13, a partial front view of the gripping tool 10 of the present disclosure is shown. FIG. 13 shows bolt head 105 engaging gear 67 (i.e., in a ratcheting configuration). When gear 102 of ratcheting assembly 70 is rotated while the gripping tool 10 of the present disclosure is in a ratcheting configuration, bolt head 105 will also rotate and cause disc 47 to rotate. If the jaws 48 are engaging a work piece, jaws 48 will not advance any closer to the center of frame 54 (i.e., because the further advancement of jaws 48 will be obstructed by the work piece), therefore disc 47 will be locked in place and the rotation of bolt head 105 will impart work onto the work piece (i.e., rotate the nut or bolt being engaged). It is to be appreciated that to impart work onto the work piece, while the work piece is being engaged by jaws 48, shaft 16 is rotated about longitudinal axis 9 to rotate wrench head 18. When wrench head 18 is rotated, a switching assembly (described below) selectively engages gear 102 in a selected direction. When gear 102 is rotated, bolt head 105 is also rotated, causing disc 47, frame 54, and cam disc 52 to rotate in unison to impart work on the work piece being gripped or engaged by jaws 48.

Figure 14:
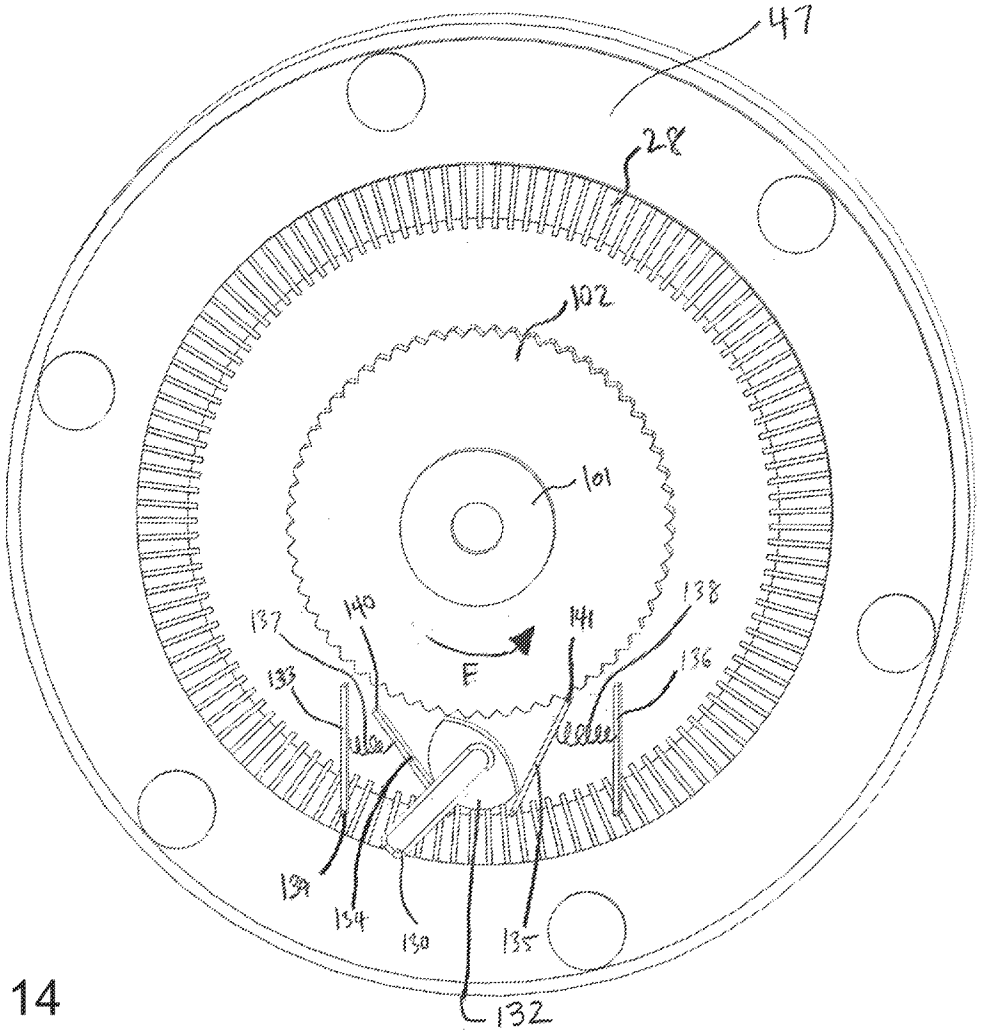
FIG. 14 is a partial rear view of several components of the adjustable gripping tool of FIG. 1A in accordance with the present disclosure.

Referring to FIG. 14, a partial rear view of gripping tool 10 is shown in accordance with the present disclosure. As shown in FIG. 14, gripping tool 10 includes four levers 133, 134, 135, 136, and switch 132. Levers 133, 134, 135, 136 and switch 132 together comprise the switching assembly of gripping tool 10. Each ratcheting lever has a pin 139 that is disposed through an aperture that is disposed in rear surface 210 (shown in FIG. 1B) of wrench head 18 to secure each lever in place. Levers 134 and 135 are configured to rotate about their respective pins, while levers 133 and 136 are configured to be fixedly coupled to the interior of wrench head 18, such that levers 133 and 136 do not move. Spring 137 is coupled to levers 133 and 134 and biases end 140 of lever 134 toward switch 132. Spring 138 is coupled to levers 135 and 136 and biases end 141 toward switch 132.

A ratcheting switch or pawl 132 that is disposed between levers 134 and 135, such that ratcheting switch 132 is in contact with levers 134 and 135. Ratcheting switch 132 is coupled to a handle 130. As shown in FIG. 1B, handle 130 is disposed on a rear surface 210 of wrench head 18. It is to be appreciated that wrench head 18 includes at least one aperture (not shown) for coupling handle 130 to switch 132. Handle 130 may be rotated clockwise or counterclockwise in relation to rear surface 210 to rotate switch 132 clockwise or counterclockwise. Switch 132 is configured to selectively engage gear 102 in a first direction of rotation or a second direction of rotation. For example, switch 132 is shaped such that, when switch 132 is rotated clockwise, as shown in FIG. 14, end 140 of lever 134 is biased toward lever 133 and spring 137 is compressed. In this position, lever 135 is not in contact with switch 132, and therefore, end 141 of lever 135 is freely biased by spring 138 toward gear 102, such that, end 141 is disposed in one of the teeth of gear 102. In this position, because of the angle of lever 135 in relation to the teeth of gear 102, gear 102 can only be rotated counterclockwise in a direction F (as indicated in FIG. 14). Alternatively, if switch 132 is rotated counterclockwise, end 141 of lever 135 is biased toward lever 136 and spring 138 is compressed. In this position, lever 134 is not in contact with switch 132, and therefore, end 140 of lever 134 is freely biased by spring 137 toward gear 102, such that, end 140 is disposed in one of the teeth of gear 102. In this position, because of the angle of lever 140 in relation to gear 102, gear 102 can only be rotated clockwise in a direction opposite to direction F (as indicated in FIG. 14). In this way, handle 130 may be rotated clockwise or counterclockwise to select which direction shaft 16 of gripping tool 10 can be rotated about axis 9 to rotate gear 102, and thus a work piece being gripped by jaws 48 while gripping tool 10 is in a ratcheting configuration.

Frame 54 is rotatably coupled to wrench head 18 (via disc 47 and ratcheting assembly 70), such that, while in a ratcheting configuration, frame 52, cam disc 52, and jaws 48 rotate in unison while work is being imparted on a work piece that is being engaged by jaws 48 when shaft 16 is rotated about wrench head 18 and longitudinal axis 9 in one direction (i.e., the direction that causes either lever 134 or 135 to engage the teeth of gear 102, as described above). While still in the ratcheting configuration, if shaft 16 is rotated in an opposite direction about longitudinal axis 9, i.e., in a direction that is not intended to impart work on the work piece (i.e., the direction that causes either lever 124 or 135 to slide over the teeth of gear 102 without engaging them, as described above), frame 54, cam disc 52, and jaws 48 will remain in place (within wrench head 18) while shaft 16 is rotated independently of frame 54, cam disc 52, and jaws 48. This configuration enables the user to regain a position of leverage with shaft 16 to again rotate shaft 16 in the opposite direction to impart more work on the work piece (i.e., "ratcheting").

In contrast, when gripping tool 10 is in an adjusting configuration (i.e., where gear 94 is in gear slot 69), frame 54 is configured to remain fixed in place in relation to cam disc 52 and jaws 48 when cam disc 52 is rotated in slot 58 of frame 54 to adjust the diameter of opening 11 created by jaws 48. In one embodiment, frame 54 is made of a heavier metal than cam disc 52, such that, when gripping tool 10 is in the adjusting configuration (i.e., where gear 94 is in gear slot 67) and adjusting gear 47 is rotated, the torque required to rotate frame 54 is lower than the torque required to rotate cam disc 52. In this way, frame 54 will remain in place relative to cam disc 52 when cam disc 52 is rotated during the adjusting configuration. It is to be appreciated that other means for holding frame 54 in place relative to cam disc 52 during the adjusting configuration may be employed as well in accordance with the present disclosure.

Figure 15A:
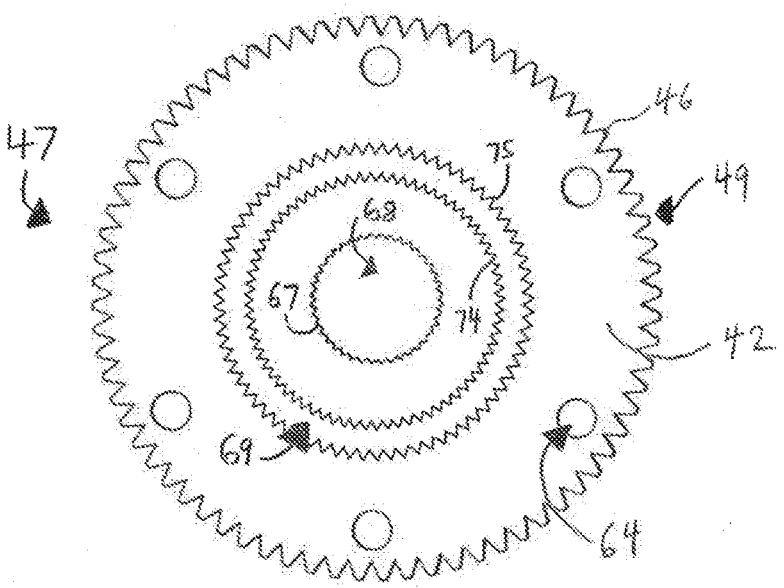
FIG. 15A is a front view of the disc of FIG. 7A including a plurality of gear teeth in an outer circumference of the disc in accordance with another embodiment of the present disclosure.
Figure 15B:
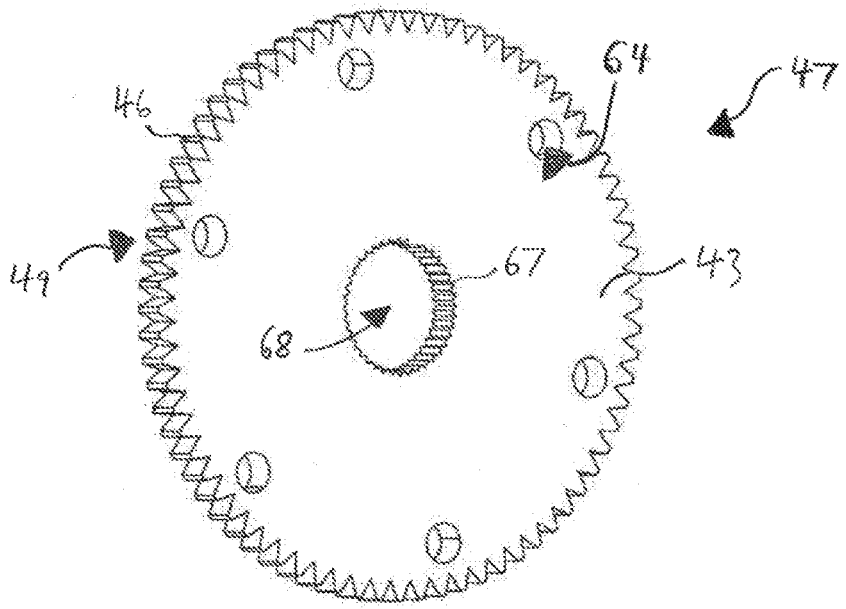
FIG. 15B is a rear perspective view of the disc of FIG. 15A in accordance with the present disclosure.
Figure 16:
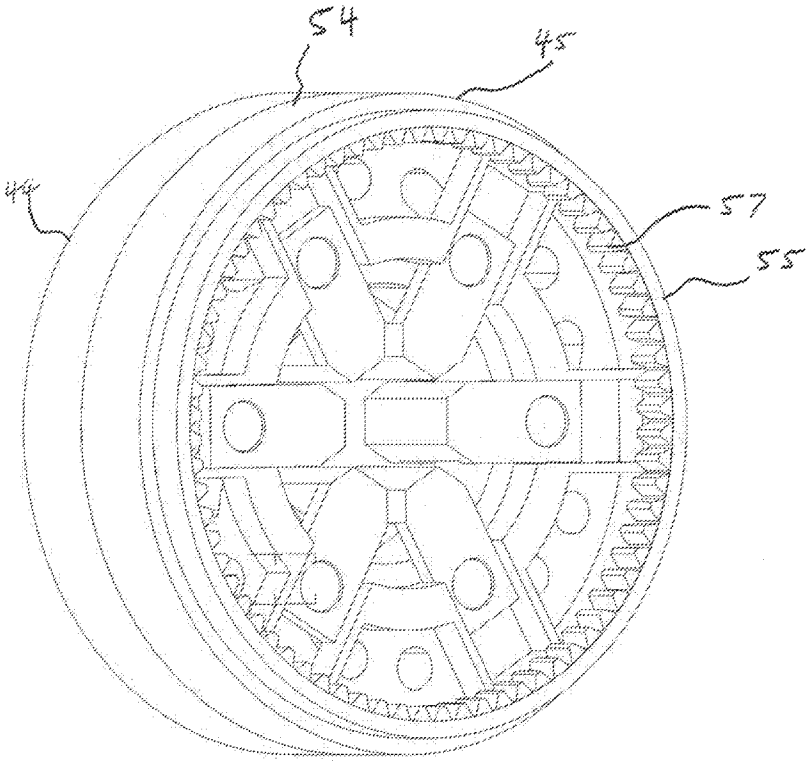
FIG. 16 is a perspective view of a frame of the adjustable gripping tool of FIG. 1A in accordance with another embodiment of the present disclosure.

Referring to FIGS. 15A-17, another embodiment including modifications to disc 47 and frame 54 are shown in accordance with the present disclosure. It is to be appreciated that all other parts, excluding disc 47 and frame 54, of gripping tool 10 are unchanged in the embodiment shown in FIGS. 15A-17. As shown in FIGS. 15A and 15B, a periphery or outer circumference 49 of disc 47 includes a plurality of gear teeth 46 disposed about the outer circumference 49. Furthermore, as shown in FIG. 16, side 45 of frame 54 includes a circular lip 55 that extends from frame 54 in a direction toward disc 47 along longitudinal axis 9. The lip 55 creates a recess to access disc 47 when disc 47 is advanced along longitudinal axis 9 toward frame 54. An inner circumference of lip 55 includes a plurality of gear teeth 57 oriented toward longitudinal axis 9, such that, the combination of lip 55 and gear teeth 57 form an internal gear on side 45 of frame 54. The circumferences of lip 55 and disc 47 are configured such that when disc 47 is advanced toward frame 54, disc 47 is inserted into the recess in side 45 created by lip 55 and teeth 46 of disc 47 mate with teeth 57 of frame 54.

Figure 17:
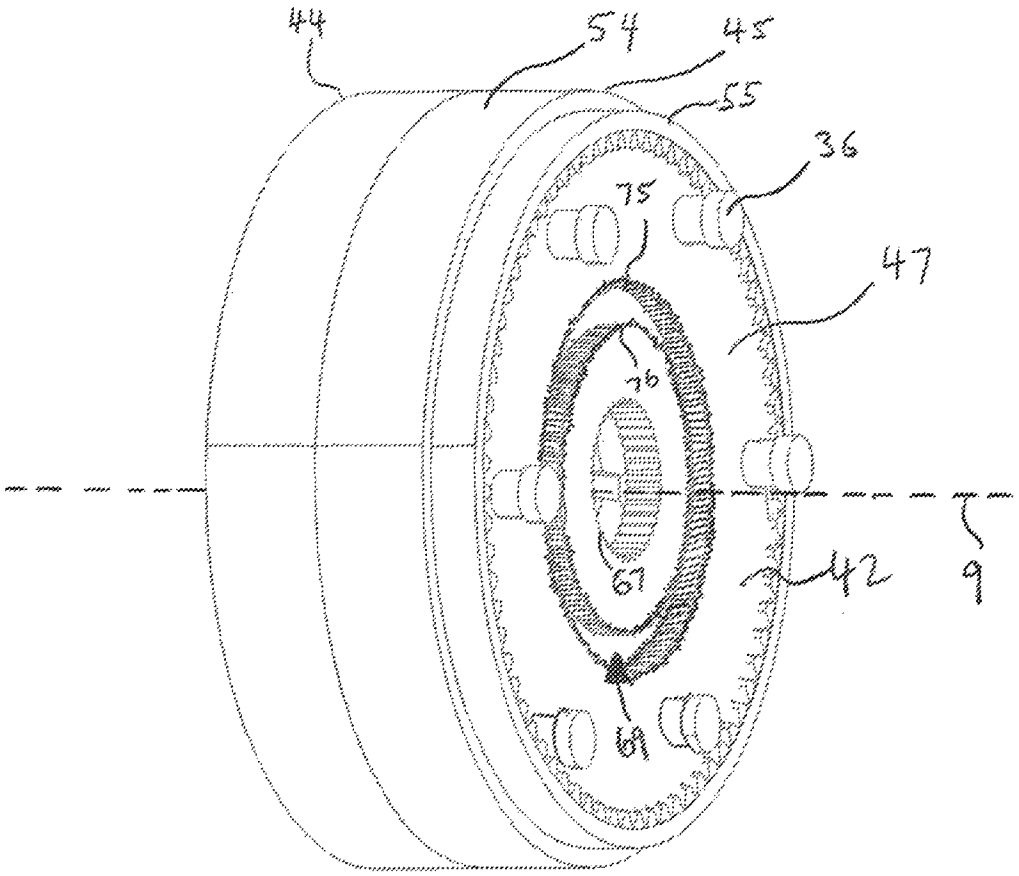
FIG. 17 is a perspective view of the disc of FIG. 15A and the frame of FIG. 16 coupled in accordance with the present disclosure.

In this way, when disc 47 is advanced toward frame 54 (i.e., during a ratcheting configuration), bolt gear 105 mates with teeth 67 of disc 47 and teeth 46 of disc 47 mate with teeth 57 of frame 54. Referring to FIG. 17, disc 47 and frame 54 are shown such that teeth 57 and 46 are mated during a ratcheting configuration of gripping tool 10 in accordance with the present disclosure. In this ratcheting configuration, when disc 47 is rotated (i.e., via a user turning or rotating shaft 16) about longitudinal axis 9, frame 54, cam disc 52, and jaws 48 all rotate in unison to impart work onto a work piece being gripped by jaws 48. When disc 47 is retracted away from frame 54 (i.e., during an adjusting configuration), teeth 67 of disc 47 disengage or are unmated with bolt gear 105 and teeth 46 of disc 47 disengage or are unmated with teeth 57 of frame 54.

In use, initially, gripping tool 10 is in an adjusting configuration (i.e., where gear 94 is disposed in gear slot 69 to couple disc 28 to disc 47). In the adjusting configuration, gripping tool 10 is disposed over a work piece (e.g., a nut or bolt) such that at least a portion of the work piece is disposed in opening 11. While the work piece is disposed in opening 11, bolt 15 is gripped (e.g., via a channel lock or other suitable tool) and rotated by a user. The rotation of bolt 15 causes the rotation of bevel gear 17, which causes the rotation of disc 28. As described above, while gripping tool 10 is in an adjusting configuration, gear 94 of disc 28 is disposed in gear slot 69 of disc 47. In this way, while gripping tool 10 is in an adjusting configuration, the rotation of bolt 15 by a user also causes the rotation of disc 47. When disc 47 is rotated, cam disc 52 is also rotated relative to frame 54 within circular slot 58. As cam disc 52 is rotated relative to frame 54 within slot 58, each rivet 50 slides within each corresponding slot 53 in a direction toward end 40 of each slot 53 to cause each jaw 48 to be advanced in a linear radial direction toward axis 9 to decrease the diameter of opening 11. Each jaw 48 is advanced in a linear radial direction toward axis 9 (i.e., via the rotation of bolt 15 by a user) until the gripping surface 71 of each jaw 48 grips the work piece securely.

After the work piece has been gripped within opening 11 by each of jaws 48, the user may press button 101 to change gripping tool 10 from an adjusting configuration to a ratcheting configuration. When button 101 is pressed, sliding members 103 (which are coupled to disc 47) advance along axis 9 toward frame 54 (independently of main body 107 of ratcheting assembly 70) to cause disc 47 to advance along axis 9 toward frame 54. When disc 47 is advanced along axis 9 toward frame 54, gear 94 is removed or disengages gear slot 69 and disc 47 is advanced along axis 9 toward frame 54 until bolt 105 mates with or engages gear teeth 67. Additionally, in some embodiments, gear teeth 46 of disc 47 may also mate with gear teeth 57 of frame 54 (as described above in relation to FIGS. 15A-17). When bolt 105 mates with gear teeth 67 (and gear teeth 46 mate with gear teeth 57), gripping tool is in a ratcheting configuration.

While in the ratcheting configuration, the shaft 16 (via handle 20) may be gripped by a user and rotated clockwise or counter clockwise about axis 9. When handle 20 is rotated about axis 9, wrench head 18 is also rotated about axis 9. Switch 132 is mounted to wrench head 18 and switch 132 is configured to selectively engage gear 102 of ratcheting assembly 70 in a first direction of rotation or a second direction of rotation, such that the rotation of shaft 16 about axis 9 will only rotate gear 102 if switch 132 selectively engages gear 102 in the same direction. For example, referring to FIG. 14, switch 132 is shown selectively engaging gear 102 in a direction of rotation such that if shaft 16 is rotated in a direction opposite to direction F about axis 9, switch 132 will engaged gear 102 such that the rotational force of shaft 16 and wrench head 18 is transferred to gear 102 and gear 102 is also rotated. When gear 102 is rotated, since, bolt 105 is mated with gear teeth 67 (and gear teeth 46 are mated with gear teeth 57), when gear 102 is rotated, bolt 105 is also rotated to rotate disc 47, cam disc 52, and frame 54 in unison about axis 9 to impart work onto the work piece being gripped. Alternatively, if shaft 16 is rotated in direction F about axis 9, switch 132 will not engage gear 102 and thus will not transfer the rotational force of shaft 16 to gear 102 and gear 102 will not be rotated. In this way, shaft 16 and wrench head 18 will rotate about axis 9 in direction F, while disc 47, cam disc 52, and frame 54 are not rotated allowing a user to regain leverage to rotate shaft 16 about axis 9 in a direction opposite to direction F to impart more work onto the work piece.

After the user has finished imparting work onto the work piece, the user may press button 101 again to cause gripping tool 10 to change from the ratcheting configuration to the adjusting configuration, so that the jaws 48 can be drawn away from the work piece to withdraw gripping tool 10 from the work piece. When button 101 is pressed again, sliding members 103 are retracted along axis 9 in a direction away from frame 54. Since disc 47 is biased in a direction away from frame 54 via pistons 36, when sliding member 103 are retracted along axis 9 away from frame 54, pistons 36 decompress to cause disc 47 to also be retracted along axis 9 in a direction away from frame 54 until gear 94 is disposed in gear slot 69 to couple disc 28 to disc 47, such that, gripping tool 10 is in an adjusting configuration. While in the adjusting configuration, bolt 15 may once again be rotated to cause jaws 48 to diverge from each other in a linear radial direction away from axis 9, such that, gripping surfaces 41 of jaws 48 no longer contact and secure the work piece within opening 11. Then, gripping tool 10 may be withdrawn from the work piece.

In another embodiment of the present disclosure, handle 20 may be coupled to shaft 16 such that handle 20 is rotatable relative to shaft 16 (e.g., in response to a user twisting or turning handle 20 about shaft 16). In this embodiment, handle 20 is also coupled to rod 13, such that, when handle 20 is rotated relative to shaft 16, rod 13 is also rotated. In this way, when gripping tool 10 is in an adjusting configuration, the rotation of handle 20 is configured to control the advancement and retraction of jaws 48 in a radial direction toward or away from axis 9 to adjust the diameter of opening 11. In one embodiment, an end of handle 20 includes an opening having substantially the same shape as bolt 15, such that, when handle 20 is disposed over shaft 16, bolt 15 is disposed through the opening of handle 20. In this way, when handle 20 is rotated relative to shaft 16, the opening of handle 20 grips bolt 15 to rotate bolt 15, thereby rotating rod 13.

It is to be appreciated that the gripping tool 10 of the present disclosure has many advantages over the prior art. As described above, the area 11 defined by jaws 48 may be enlarged or reduced to grip work pieces of varying sizes without needing a plurality of socket heads that are different sizes. Besides this advantage, gripping tool 10 also provides the advantage of adjusting bolts that have been stripped due to wear or corrosion. In the event that a bolt loses its edge, it is usually extremely difficult to find an appropriate socket head to grip the bolt to rotate the bolt. Since jaws 48 of gripping tool 10 may be adjusted to any size, jaws 48 can tightly grip a stripped bolt. Furthermore, as shown in FIGS. 1A and 13, in one embodiment, jaws 48 are disposed 60 degrees apart relative to each other. This design allows the collective gripping force of jaws 48 to be spread around a stripped bolt, providing a better chance to be able to rotate a stripped bolt. This is an advantage over conventional methods of rotating a stripped bolt, which range from using a vice grip (i.e., only 2 contact points on the stripped bolt providing less effective gripping force), to using a screw extractor, which requires the unnecessary effort of boring a hole into the stripped bolt.

It is to be appreciated that in the above embodiments although gripping tool 10 includes six jaws 48, spaced approximately 60 degrees apart from each other, in other embodiments, gripping tool 10 may include more or less jaws, as desired, spaced at lower or higher angles to accommodate different bolt heads (e.g., two jaws 48, spaced 180 degrees apart, four jaws 48, spaced 90 degrees apart to accommodate a square bolt or eighth jaws 48 spaced 45 degrees apart to accommodate an octagonal bolt, etc.).

The present disclosure is not confined to the applications of ratcheting wrenches. The adjusting and ratcheting mechanisms of tool 10 disclosed above may be used in any application which requires work (i.e., torque) to be applied to a work piece.

It is to be appreciated that the various features shown and described are interchangeable, that is a feature shown in one embodiment may be incorporated into another embodiment.

While non-limiting embodiments are disclosed herein, many variations are possible which remain within the concept and scope of the present disclosure. Such variations would become clear to one of ordinary skill in the art after inspection of the specification, drawings and claims herein. The present disclosure therefore is not to be restricted except within the spirit and scope of the appended claims.

Furthermore, although the foregoing text sets forth a detailed description of numerous embodiments, it should be understood that the legal scope of the present disclosure is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . "or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

What is claimed is:

1. An adjustable gripping tool, comprising:

a generally cylindrical frame aligned along an axis, the frame including at least a first and second radial slot;

at least a first and second jaw, each jaw slidably disposed in a respective radial slot such that the motion of each jaw is limited to linear radial motion toward or away from the axis, a first disc rotatable about the axis and coupled to each of the jaws such that the rotation of the first disc with respect to the frame advances or retracts each jaw within each radial slot toward or away from the axis, and wherein the first disc is slidable along the axis with respect to the frame in a direction toward or away from the frame;

a second disc rotatable about the axis;

a ratcheting assembly including a main body and a sliding member, the main body including a first end and a second end aligned along the axis, the main body rotatable about the axis, the second end including a gear, the sliding member coupled to the first disc and configured to slide along the axis independently from the main body in a direction toward or away from the frame to slide the first disc toward or away from the frame; and a switching assembly coupled to the gear of the main body and configured to engage the gear to selectively rotate the gear in a first direction or a second direction about the axis, wherein when the sliding member is advanced along the axis in a direction toward the frame, the first disc is advanced along the axis and the first end of the main body of the ratcheting assembly is coupled to the first disc such that the rotation of the gear of the main body controls the rotation of the first disc, and wherein when the sliding member is retracted along the axis in a direction away from the frame, the first disc is retracted along the axis and is uncoupled from the first end of the main body of the ratcheting assembly and the first disc is coupled to the second disc such that the rotation of the second disc controls the rotation of the first disc.

2. The adjustable gripping tool of claim 1, wherein each jaw includes a first surface oriented toward the axis, the surfaces of the at least first and second jaws defining an adjustable opening configured to receive a work piece, and wherein when the first disc is coupled to the second disc, the second disc may be rotated about the axis such that the work piece is gripped by the first surfaces of each respective jaw.

3. The adjustable gripping tool of claim 2, wherein after the work piece is gripped by each of the jaws, the sliding member may be advanced along the axis toward the frame to couple the first disc to the first end of the main body and the gear of the main body may be rotated to rotate first disc and the frame in unison to impart work onto the work piece.

4. The adjustable gripping tool of claim 1, wherein the second disc includes an aperture, and the main body and sliding member are disposed through the aperture of the second disc.

5. The adjustable gripping tool of claim 1, wherein the first disc includes an aperture defined by an inner circumference of the first disc, wherein the inner circumference of the first disc includes a plurality of gear teeth disposed about the inner circumference and the first end of the main body includes a gear configured to mate with the plurality of gear teeth of the first disc when the first end of the main body is coupled to the first disc.

6. The adjustable gripping tool of claim 1, wherein the first disc includes a gear slot and the second disc includes a surface and a gear tab protruding from the surface, wherein when the first disc is coupled to the second disc, the gear tab is disposed in the gear slot.

7. The adjustable gripping tool of claim 1, wherein the main body includes a channel extending from the first end to the second end of the main body and an aperture in a side of the main body, the aperture providing access to a portion of the channel, the ratcheting assembly including a pin that is at least partially disposed in the channel and slidable within the channel along the axis in a direction toward or away from the frame, wherein the sliding member is coupled to the pin, the pin controlling the sliding of the first disc along the axis.

8. The adjustable gripping tool of claim 1, wherein an outer circumference of the first disc includes a plurality of gear teeth disposed about the outer circumference and the frame includes a side having a lip, the lip having an inner circumference including a plurality of gear teeth disposed about the inner circumference, wherein when the first disc is advanced along the axis toward the frame, the plurality of gear teeth of the outer circumference of the first disc mate with the plurality of gear teeth of the inner circumference of the lip, such that, when the first disc is rotated, the frame, came disc, and at least first and second jaws are rotated in unison.

9. The adjustable gripping tool of claim 1, wherein the frame includes a circular slot in an inner circumference of the frame and the adjustable gripping tool further comprises a cam disc slidably disposed in the circular slot such that the cam disc is rotatable with respect to the frame about the axis, the first disc coupled to the cam disc such that when the first disc is rotated, the second disc is also rotated, the cam disc including at least a first and second guide slot, each guide slot including a first end and a second end, the second end of each guide slot disposed more proximately to the axis than the first end of each guide slot, and wherein an end of each of the jaws is slidably coupled to a respective guide slot such that when the cam disc is rotated with respect to the frame about the axis each of the jaws advanced or retraced toward or away from the axis.

10. The adjustable gripping tool of claim 9, wherein the first disc is coupled to the cam disc via a plurality of compressible pistons, the plurality of pistons biasing the first disc in a direction away from the frame along the axis.

11. The adjustable gripping tool of claim 1, further comprising a housing, the housing including a generally cylindrical head portion, the head portion including an opening revealing a hollow interior, wherein the first disc, second disc, and ratcheting assembly are disposed in the hollow interior of the head portion, the switching assembly mounted to a surface of the hollow interior of the head portion.

12. The adjustable gripping tool of claim 11, wherein the housing includes a shaft having a first end and a second end and disposed perpendicularly to the axis, the first end coupled to the head portion, the shaft enabling the head portion to be rotated about the axis, such that, the switching assembly selectively rotates the gear of the main body about the axis.

13. The adjustable gripping tool of claim 12, wherein the second disc includes a plurality beveled gear teeth and the adjustable gripping tool further comprises an adjusting member including a bevel gear, a rod portion, and a bolt, the rod portion including a first end and a second end, the bevel gear of the adjusting member coupled to the first end of the rod portion and the bolt coupled to the second end of the rod portion, wherein the rod portion is disposed through the hollow interior of the shaft such that the bevel gear extends into the hollow interior of the head portion and is coupled to the plurality of beveled gear teeth of the second disc and the bolt extends passed the second end of the shaft, the bolt is configured to be rotated to rotate the second disc.

14. The adjustable gripping tool of claim 13, further comprising a handle disposed over the shaft, the handle coupled to the rod portion and rotatable about the shaft, such that, when the handle is rotated about the shaft, rod portion is rotated.

15. The adjustable gripping tool of claim 11, further comprising ring mount mounted to the interior of the head portion of the housing, the ring mount coupled to an outer circumference of second disc to mount the second disc to the interior of the head portion, such that, the second disc is rotatable about the axis relative to the ring mount.

16. The adjustable gripping tool of claim 15, further comprising a plurality of ball bearings disposed between an inner circumference of the ring mount and an outer circumference of the second disc to enable the rotation of the second disc with respect to the ring mount.

17. The adjustable gripping tool of claim 11, further comprising a button disposed on an exterior surface of the head portion, the button coupled to sliding member and configured to control the advancement and retraction of the sliding member along the axis.

18. The adjustable gripping tool of claim 11, further comprising a handle disposed on an exterior surface of the head portion and coupled to the switching assembly, such that, the handle may be rotated in a first direction or a second direction to choose the direction the gear of the main body may be selectively rotated via the switching assembly.

19. An adjustable gripping tool, comprising:

a generally cylindrical frame aligned along an axis, the frame including a circular slot disposed in an inner circumference of the frame and at least a first and second radial slot;

a cam disc slidably disposed in the circular slot such that the cam disc is rotatable with respect to the frame about the axis, the cam disc including at least a first and second guide slot, each guide slot including a first end and a second end, the second end of each guide slot disposed more proximately to the axis than the first end of each guide slot;

at least a first and second jaw, each jaw slidably disposed in a respective radial slot such that the motion of each jaw is limited to linear radial motion toward or away from the axis, each jaw including a first end and a second end, the first end having a first surface facing the axis, the second end of each jaw is slidably coupled to a respective guide slot, wherein the cam disc is rotated about the axis with respect to the frame to advance or retract each jaw within each radial slot toward or away from the axis;

a first disc rotatable about the axis and including a first side and a second side, the first side coupled to the cam disc such that when the first disc is rotated about the axis, the cam disc is rotated about the axis, and such that the first disc is slidable along the axis with respect to the frame and cam disc in a direction toward or away from the frame;

a second disc including a first side and a second side, the second disc rotatable about the axis;

a ratcheting assembly including a main body and a sliding member, the main body including a first end and a second end aligned along the axis, the main body rotatable about the axis, the first end disposed more proximately to the frame than the second end, the second end including a gear, the sliding member coupled to the second side of the first disc and configured to slide along the axis independently from the main body in a direction toward or away from the frame to slide the first disc toward or away from the frame; and a switching assembly coupled to the gear of the main body and configured to engage the gear to selectively rotate the gear in a first direction or a second direction about the axis, wherein when the sliding member is advanced along the axis in a direction toward the frame, the first disc is advanced along the axis and the first end of the main body of the ratcheting assembly is coupled to the first disc such that the rotation of the gear of the main body controls the rotation of the first disc, and wherein when the sliding member is retracted along the axis in a direction away from the frame, the first disc is retracted along the axis and is uncoupled from the first end of the main body of the ratcheting assembly and the second side of the first disc is coupled to the first side of the second disc such that the rotation of the second disc controls the rotation of the first disc.

20. An adjustable gripping tool, comprising:

a generally cylindrical frame aligned along an axis, the frame rotatable about the axis and including a circular slot disposed in an inner circumference of the frame, at least a first and second radial slot, a first side, and a second side;

a cam disc slidably disposed in the circular slot such that the cam disc is rotatable with respect to the frame about the axis, the cam disc including at least a first and second guide slot, each guide slot including a first end and a second end, the second end of each guide slot disposed more proximately to the axis than the first end of each guide slot;

at least a first and second jaw, each jaw slidably disposed in a respective radial slot such that the motion of each jaw is limited to linear radial motion toward or away from the axis, each jaw including a first end and a second end, the first end having a first surface facing the axis, the second end of each jaw is slidably coupled to a respective guide slot, wherein the cam disc is rotated about the axis with respect to the frame to advance or retract each jaw within each radial slot toward or away from the axis;

a first disc rotatable about the axis and including a first side and a second side, the first side coupled to the cam disc such that when the first disc is rotated about the axis, the cam disc is rotated about the axis, and such that the first disc is slidable along the axis with respect to the frame and cam disc in a direction toward or away from the frame;

a second disc including a first side and a second side, the second disc rotatable about the axis;

a ratcheting assembly including a main body and a sliding member, the main body including a first end and a second end aligned along the axis, the main body rotatable about the axis, the first end disposed more proximately to the frame than the second end, the second end including a gear, the sliding member coupled to the second side of the first disc and configured to slide along the axis independently from the main body in a direction toward or away from the frame to slide the first disc toward or away from the frame; and a switching assembly coupled to the gear of the main body and configured to engage the gear to selectively rotate the gear in a first direction or a second direction about the axis, wherein when the sliding member is advanced along the axis in a direction toward the frame, the first disc is advanced along the axis and the first side of the first disc is coupled to the second side of the frame and the first end of the main body of the ratcheting assembly is coupled to the first disc such that the rotation of the gear of the main body causes the frame, the cam disc, and first disc to be rotated in unison about the axis, and wherein when the sliding member is retracted along the axis in a direction away from the frame, the first disc is retracted along the axis and is uncoupled from the first end of the main body of the ratcheting assembly and the second side of the frame and the second side of the first disc is coupled to the first side of the second disc such that the rotation of the second disc controls the rotation of the first disc.

* * * * *